US006510721B1

(12) United States Patent
Yamamoto et al.

(10) Patent No.: US 6,510,721 B1
(45) Date of Patent: Jan. 28, 2003

(54) ROLLING MILL

(75) Inventors: Mikio Yamamoto, Hiroshima (JP); Atsushi Higashio, Hiroshima (JP); Hideaki Furumoto, Hiroshima (JP); Naoki Morihira, Hiroshima (JP); Kanji Hayashi, Hiroshima (JP); Mitsuhiro Yoshida, Hiroshima (JP); Kazuo Morimoto, Chiyoda-ku (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 0 days.

(21) Appl. No.: 09/807,269

(22) PCT Filed: Aug. 8, 2000

(86) PCT No.: PCT/JP00/05302

§ 371 (c)(1),
(2), (4) Date: Jun. 11, 2001

(87) PCT Pub. No.: WO01/12353

PCT Pub. Date: Feb. 22, 2001

(30) Foreign Application Priority Data

Aug. 11, 1999 (JP) ..... 11-227349
Jun. 22, 2000 (JP) ..... 2000-187163

(51) Int. Cl.[7] ..... B21B 31/07; B21B 31/32

(52) U.S. Cl. ..... 72/245; 72/10.6; 72/14.5; 72/28.2; 72/237; 72/244; 72/248

(58) Field of Search ..... 72/10.4, 10.6, 72/14.4, 14.5, 28.2, 237, 244, 245, 248

(56) References Cited

U.S. PATENT DOCUMENTS 4,218,905 A * 8/1980 Lehmann et al. ..... 72/245
6,354,128 B1 * 3/2002 Donini et al. ..... 72/237

FOREIGN PATENT DOCUMENTS

| | | | |
|---|---|---|---|
| EP | A2-1005921 | 3/1999 | |
| JP | 2-151310 | * 6/1990 | ..... 72/245 |
| JP | A5293518 | 11/1993 | |
| JP | A9174122 | 7/1997 | |
| JP | A9285805 | 11/1997 | |
| JP | A2000167605 | 6/2000 | |

* cited by examiner

*Primary Examiner*—Ed Tolan
(74) *Attorney, Agent, or Firm*—Birch, Stewart, Kolasch & Birch, LLP

(57) ABSTRACT

Work rolls opposed to each other have shafts rotatably supported by upper and lower work roll chocks of a housing, a screw down device for applying a predetermined pressure to the upper work roll is provided in an upper portion of the housing, screw mechanisms capable of thrusting the work roll chocks in a horizontal direction are provided on an entry side or a delivery side of the housing, hydraulic cylinder mechanisms capable of thrusting the work roll chocks in the horizontal direction are provided on the other side, and contraction portions are provided in hydraulic supply and discharge pipes of the hydraulic cylinder mechanisms.

11 Claims, 17 Drawing Sheets

(a)

(b)

(a) $\delta' > 0$ (b) $\delta' \leqq 0$ (a)

(b)

(c)

ROLLING MILL

This application is the national phase under 35 U.S.C. §371 of PCT International Application No. PCT/JP00/05302 which has an International filing date of Aug. 8, 2001, which designated the United States of America and was published in English.

TECHNICAL FIELD

This invention relates to a rolling mill for rolling a strip material or a bar material, which passes through upper and lower work rolls, to a predetermined thickness. More particularly, the invention relates to a rolling mill preferred for use in hot rolling.

BACKGROUND ART

FIG. 15 schematically shows a conventional four high cross rolling mill, and FIG. 16 schematically shows an essential part for illustrating a roll replacement operation in a cross rolling mill.

As shown in FIG. 15, upper and roller work roll chocks 002 and 003 as a pair are supported inside a housing 001. Shaft portions of upper and lower work rolls 004 and 005 as a pair are rotatably supported by the upper and lower work roll chocks 002 and 003, respectively, and the upper work roll 004 and the lower work roll 005 are opposed to each other. Upper and lower backup roll chocks 006 and 007 as a pair are supported above and below the upper and lower work roll chocks 002 and 003. Shaft portions of upper and lower backup rolls 008 and 009 as a pair are rotatably supported by the upper and lower backup roll chocks 006 and 007, respectively. The upper backup roll 008 and the upper work roll 004 are opposed to each other, while the lower backup roll 009 and the lower work roll 005 are opposed to each other. A screw down device 010 for imposing a rolling load on the upper work roll 004 via the upper backup roll chock 006 and the upper backup roll 008 is provided in an upper portion of the housing 001.

Upper crossheads 011 and 012 for horizontally supporting the upper backup roll chock 006 and the upper work roll chock 002 are provided in the upper portion of the housing 001 and positioned on an entry side and a delivery side of the housing 001. The upper crossheads 011, 012 are horizontally movable by screw mechanisms 013, 014. Lower crossheads 015 and 016 for horizontally supporting the lower backup roll chock 007 and the lower work roll chock 003 are provided in a lower portion of the housing 001 and positioned on the entry side and the delivery side of the housing 001. The lower crossheads 015, 016 are horizontally movable by screw mechanisms 017, 018.

Thus, when rolling is performed, a strip S is fed from the entry side of the housing 001, and passed between the upper work roll 004 and the lower work roll 005 given a predetermined load by the screw down device 010, whereby the strip S is rolled. The rolled strip S is delivered from the delivery side and supplied to a subsequent step.

The screw mechanisms 013, 014, 017, 018 are actuated before or during rolling, whereby the upper chocks 002, 006 and the lower chocks 003, 007 are moved in different directions via the crossheads 011, 012, 015, 016. As a result, the upper work roll 004 and the upper backup roll 008, and the lower work roll 005 and the lower backup roll 009 are turned in opposite directions about a roll center so that their rotation axes may cross each other and the angle of their crossed axes may be set at a required angle. By so doing, the strip crown is controlled.

For roll replacement, moreover, the screw mechanisms 013, 014, 017, 018 are actuated to separate the crossheads 011, 012, 015, 016 from the chocks 002, 003, 006, 007 and form gaps g between the roll chocks 002, 003, 006, 007 and the crossheads 011, 012, 015, 016, as shown in FIG. 16. Thus, the upper and lower work rolls 004 and 005 and the upper and lower backup rolls 008 and 009 can be withdrawn from a work side by a predetermined device without interference by the crossheads 011, 012, 015, 016, and can be replaced with new ones.

In all rolling mills including the foregoing four high cross rolling mill, hysteresis during vertical control of the work rolls 004, 005 and backup rolls 008, 009 in the housing 001 needs to be minimized in a rolling condition under a screw down force F to control the thickness of a rolled plate highly accurately. For this purpose, gaps G are formed between the work roll chocks 002, 003 and backup roll chocks 006, 007 and the crossheads 011, 012, 015, 016 or housing 001.

Thus, as shown in FIG. 17, even when deformation in an inward narrowing amount of $\delta$ is caused to the housing 001 under the screw down load F during rolling, gaps of about 0.2 mm to 1.0 mm are present between the roll chocks 002, 003, 006, 007 and the housing 001 or crossheads 011, 012, 015, 016, so that the horizontal dynamic stiffness of the rolling mill may be low. If rolling is performed with a high rolling force and a high percentage reduction in the thickness of the strip while the horizontal dynamic stiffness of the rolling mill is low, great vibrations probably attributed to, for example, friction between the strip S being rolled and the work rolls 004, 005 (hereinafter referred to as mill vibrations) occur in the housing 001 or the work rolls 004, 005, thereby impeding high efficiency rolling.

As means of preventing vibrations in a rolling mill, Japanese Unexamined Patent Publication No. 1997-174122 discloses a rolling mill provided with a damper comprising a piston, a cylinder and an orifice between an upper work roll and a lower work roll. However, the vibration preventing device of the rolling mill disclosed in this publication is applied to cold rolling, and its application to hot rolling is difficult. That is, in cold rolling, a strip maintained in a room temperature condition is engaged at a low speed between upper and lower work rolls, and continuously rolled. In hot rolling, on the other hand, a strip heated in a high temperature state is engaged at a high speed between upper and roller work rolls, and rolled for each coil of a predetermined length. Thus, hot rolling causes a higher impact force at the time of engagement of the strip with the upper and lower work rolls, and faces impact more frequently, than cold rolling. Furthermore, hot rolling has a greater rolling amount of the strip (a higher rolling force on the strip) than cold rolling, so that the frictional force acting between the work roll and the strip is also higher. This is another factor which makes the impact force greater during engagement. As noted here, hot rolling generates a higher impact force during strip engagement than cold rolling. Hence, the aforementioned vibration preventing device of the rolling mill, which is applied to cold rolling, cannot fully prevent roll vibrations during rolling.

The present invention has been accomplished to solve these problems, and its object is to provide a rolling mill which eliminates gaps between roll chocks and a housing during rolling to increase horizontal dynamic stiffness, thereby suppressing mill vibrations and permitting high efficiency rolling.

DISCLOSURE OF THE INVENTION

A rolling mill of the present invention for attaining the above-mentioned object comprises a housing, upper and lower work roll chocks as a pair supported by the housing, upper and lower work rolls as a pair opposed to each other and having shafts rotatably supported by the upper and lower work roll chocks, screw down means provided in an upper portion of the housing and adapted to apply a predetermined pressure to the upper work roll, first upper and lower support means as a pair provided on one side in a transport direction of a strip material in the housing and adapted to support the upper and lower work roll chocks, and second upper and lower support means as a pair provided on the other side in the transport direction of the strip material in the housing and adapted to support the upper and lower work roll chocks, one of the first support means and the second support means is mechanical thrust means, while the other of the first support means and the second support means is hydraulic thrust means, and contraction portions are provided in hydraulic supply and discharge pipes of the hydraulic thrust means.

Thus, the first thrust means and the second thrust means are actuated during rolling to eliminate gaps between the roll chocks and the housing and increase the horizontal dynamic stiffness, thereby suppressing mill vibrations and permitting high efficiency rolling.

In the rolling mill of the present invention, the rolling mill may be a cross rolling mill with the upper and lower work rolls slightly crossing each other, the first support means may be entry-side thrust means provided on an entry side of the housing and capable of thrusting the upper and lower work roll chocks in the transport direction of the strip material, and the second support means may be delivery-side thrust means provided on a delivery side of the housing and capable of thrusting the upper and lower work roll chocks in the transport direction of the strip material. By so doing, high efficiency rolling can be performed in the cross rolling mill with mill vibrations being suppressed.

In the rolling mill of the present invention, the mechanical thrust means may be screw mechanisms. By so doing, positioning of the rolls during rolling can be performed with high accuracy.

In the rolling mill of the present invention, the mechanical thrust means may be wedge mechanisms. By so doing, positioning of the rolls during rolling can be performed highly accurately without rattling. Furthermore, the structure can be simplified to decrease the manufacturing cost.

In the rolling mill of the present invention, there may be provided upper and lower backup roll chocks as a pair supported by the housing, and upper and lower backup rolls as a pair opposed to each other and having shafts rotatably supported by the upper and lower backup roll chocks, one of upper and lower entry-side thrust means and delivery-side thrust means as a pair capable of thrusting the upper and lower backup roll chocks in a horizontal direction may be mechanical thrust means, while the other of the entry-side thrust means and delivery-side thrust means may be hydraulic thrust means, and contraction portions may be provided in hydraulic supply and discharge pipes of the hydraulic thrust means. By so doing, at the positions of the backup rolls as well as at the positions of the upper and lower work rolls, gaps between the roll chocks and the crossheads or the housing during rolling are eliminated to increase the horizontal dynamic stiffness, thereby suppressing mill vibrations and permitting high efficiency rolling.

In the rolling mill of the present invention, the diameters of the contraction portions may be variable. Thus, the workability can be increased, and vibrations can be suppressed efficiently, by adjusting the diameters of the contraction portions to appropriate values during rolling, or at the time of setting a roll cross angle, or in accordance with the magnitude of vibrations.

In the rolling mill of the present invention, the diameters of the contraction portions may be maximized at the time of setting a cross angle between the upper and lower work rolls, and the diameters of the contraction portions during rolling by the upper and lower work rolls may be set at appropriate predetermined values for each of the rolling conditions. By so doing, the diameters of the contraction portions are maximized at the time of setting the roll cross angle, so that the work rolls can be moved smoothly. During rolling, the diameters of the contraction portions are adjusted to appropriate values, whereby vibrations can be suppressed reliably.

In the rolling mill of the present invention, the contraction portions may be electromagnetic valves. By the changing operation of the electromagnetic valves, maximization and minimization of the contraction portions can be carried out smoothly to increase workability.

In the rolling mill of the present invention, enlarged portions may be provided in the hydraulic supply and discharge pipes. By so doing, a pressure wave generated in the hydraulic supply and discharge pipe by mill vibrations, etc. is suppressed at the enlarged portion, so that occurrence of a resonance phenomenon can be prevented.

In the rolling mill of the present invention, the rolling mill may be an offset rolling mill in which upper and lower backup rolls as a pair in contact with the upper and lower work rolls, respectively, may be supported by the housing via backup roll chocks, and the upper and lower backup rolls may be slightly displaced relative to the upper and lower work rolls rearward in the transport direction of the strip material, the first support means may be hydraulic thrust means provided on one of an entry side and a delivery side of the housing, being capable of thrusting the upper and lower work roll chocks in the transport direction of the strip material, and having the contraction portions, and the second support means may be housing liner portions provided on the other of the entry side and the delivery side of the housing.

By so doing, high efficiency rolling can be performed in the offset rolling mill, with mill vibrations being suppressed.

In the rolling mill of the present invention, the rolling mill may be a shift rolling mill for shifting the upper and lower work rolls as a pair in a roll axis direction, the first support means may be hydraulic thrust means provided on one of an entry side and a delivery side of the housing, being capable of thrusting the upper and lower work roll chocks in the transport direction of the strip material, and having the contraction portions, and the second support means may be housing liner portions provided on the other of the entry side and the delivery side of the housing. By so doing, high efficiency rolling can be performed in the shift rolling mill, with mill vibrations being suppressed.

BEST MODE FOR CARRYING OUT THE INVENTION

Embodiments of the present invention will now be described in detail based on the accompanying drawings.

[First Embodiment]

Figure 1:
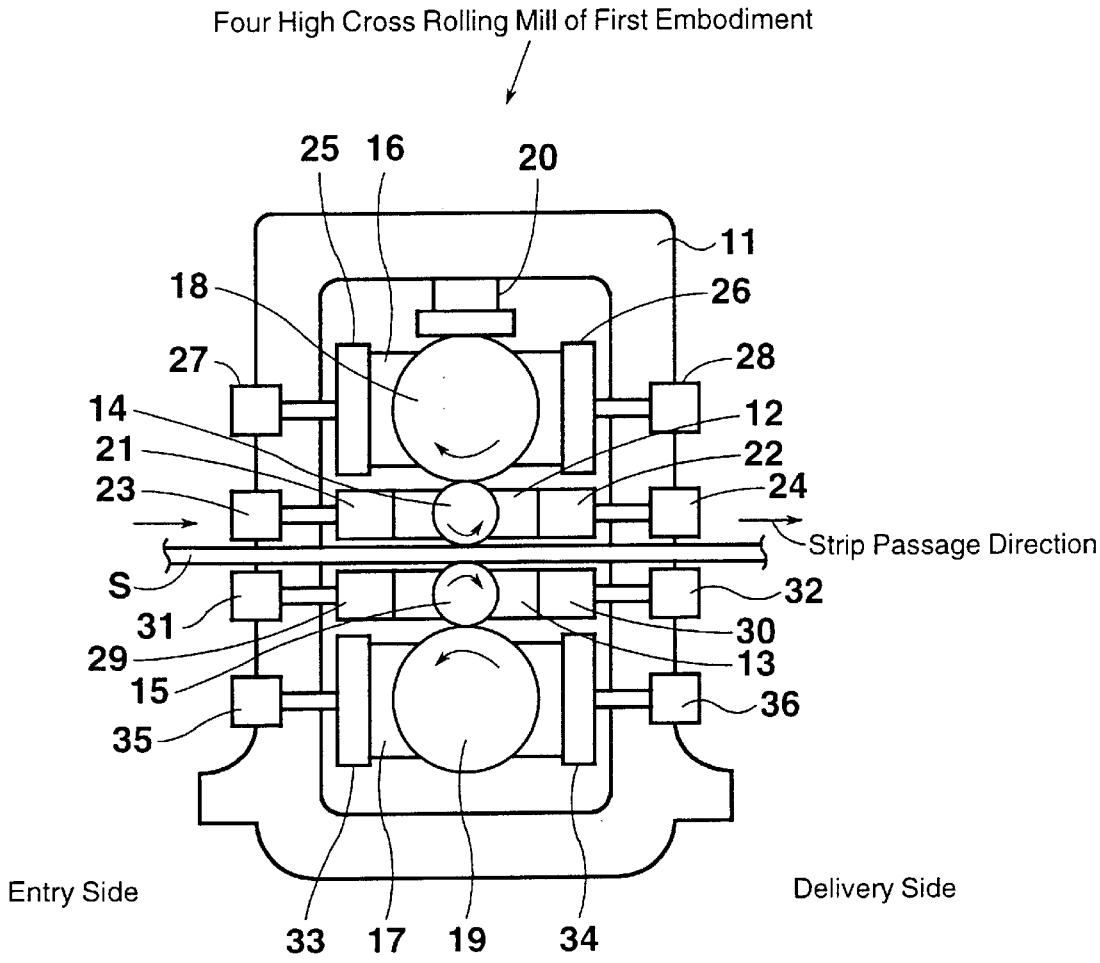
FIG. 1 is a schematic view of a cross rolling mill as a rolling mill according to a first embodiment of the present invention.

In a four high cross rolling mill as a rolling mill according to a first embodiment, as shown in FIG. 1, upper and roller work roll chocks 12 and 13 as a pair are supported inside a housing 11. Shaft portions of upper and lower work rolls 14 and 15 as a pair are rotatably supported by the upper and lower work roll chocks 12 and 13, respectively, and the upper work roll 14 and the lower work roll 15 are opposed to each other. Upper and lower backup roll chocks 16 and 17 as a pair are supported above and below the upper and lower work roll chocks 12 and 13. Shaft portions of upper and lower backup rolls 18 and 19 as a pair are rotatably supported by the upper and lower backup roll chocks 16 and 17, respectively. The upper backup roll 18 and the upper work roll 14 are opposed to each other, while the lower backup roll 19 and the lower work roll 15 are opposed to each other. A screw down device 20 for imposing a rolling load on the upper work roll 14 via the upper backup roll 18 is provided in an upper portion of the housing 11.

Upper crossheads 21 and 22 for supporting the upper work roll chock 12 are provided in the upper portion of the housing 11 and positioned on an entry side and a delivery side of the housing 11. The upper crossheads 21 and 22 are horizontally movable by a screw mechanism (first support means, mechanical thrust means) 23 and a hydraulic cylinder mechanism (second support means, hydraulic thrust means) 24 for roll cross. Upper crossheads 25 and 26 for supporting the upper backup roll chock 16 are provided above the upper crossheads 21 and 22 on the entry side and the delivery side of the housing 11. The upper crossheads 25 and 26 are horizontally movable by a screw mechanism (mechanical thrust means) 27 and a hydraulic cylinder mechanism (hydraulic thrust means) 28 for roll cross. On the other hand, lower crossheads 29 and 30 for supporting the lower work roll chock 13 are provided in a lower portion of the housing 11 and positioned on the entry side and the delivery side of the housing 11. The lower crossheads 29 and 30 are horizontally movable by a screw mechanism (mechanical thrust means) 31 and a hydraulic cylinder mechanism (hydraulic thrust means) 32. Lower crossheads 33 and 34 for supporting the lower backup roll chock 17 are provided below the lower crossheads 29 and 30 on the entry side and the delivery side of the housing 11. The lower crossheads 33 and 34 are horizontally movable by a screw mechanism (mechanical thrust means) 35 and a hydraulic cylinder mechanism (hydraulic thrust means) 36.

Figure 2:
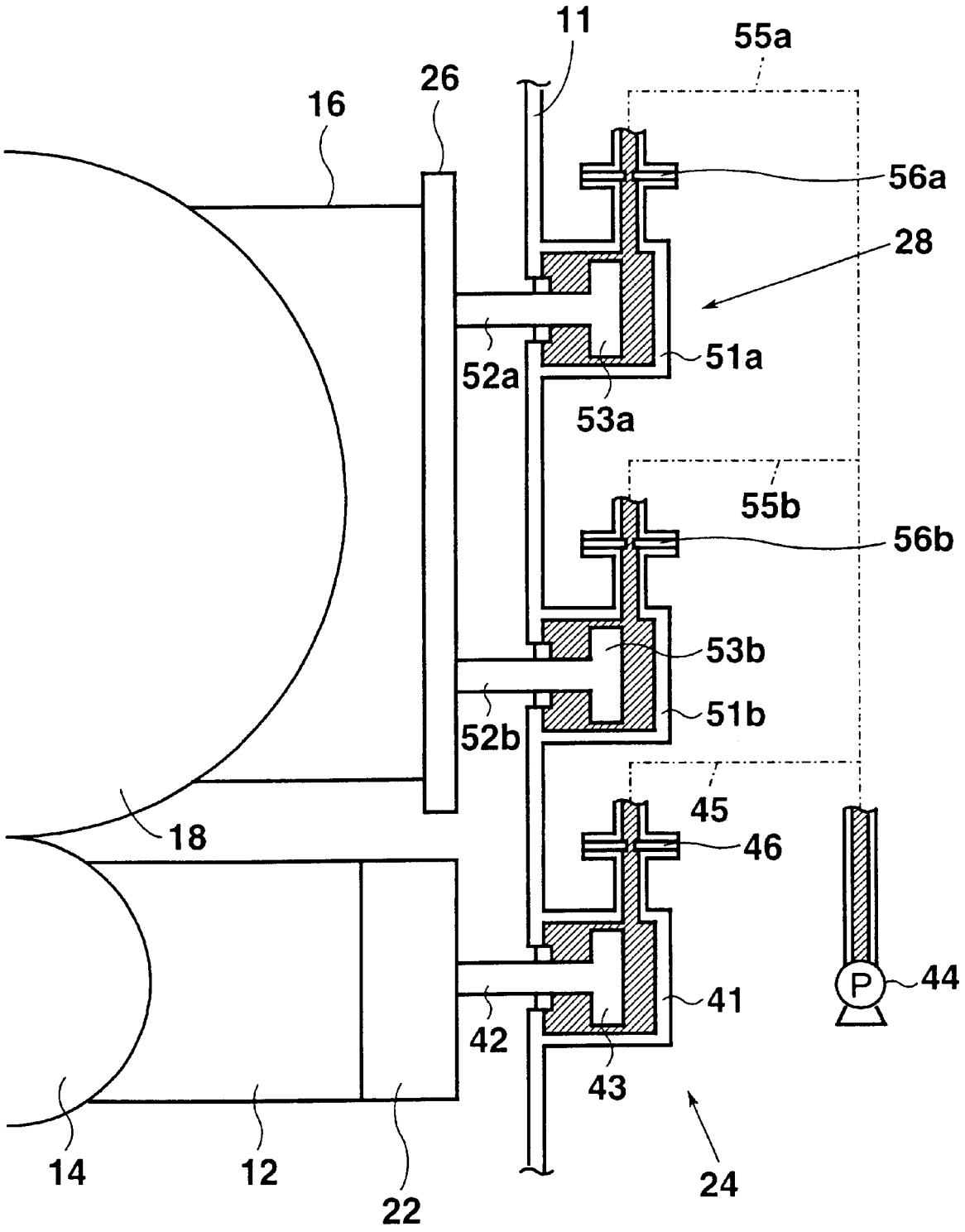
FIG. 2 is a schematic view of thrust mechanisms for an upper work roll and an upper backup roll.

The hydraulic cylinder mechanism 24 for the upper crosshead 22 corresponding to the upper work roll 14, as shown in FIG. 2, is composed of a cylinder 41 fixed to the housing 11, a piston 43 connected to the upper crosshead 22 via a rod 42 and movable in the cylinder 41, a hydraulic pump 44, a hydraulic supply and discharge pipe 45 connecting the hydraulic pump 44 and the cylinder 41, and a contraction portion 46 provided in the hydraulic supply and discharge pipe 45. On the other hand, the hydraulic cylinder mechanism 28 for the upper crosshead 26 corresponding to the upper backup roll 18 is composed of a pair of cylinders 51*a* and 51*b* fixed to the housing 11, pistons 53*a*, 53*b* connected to the upper crosshead 26 via rods 52*a*, 52*b* and movable in the cylinders 51*a*, 51*b*, the hydraulic pump 44, hydraulic supply and discharge pipes 55*a*, 55*b* connecting the hydraulic pump 44 and the cylinders 51*a*, 51*b*, and contraction portions 56*a*, 56*b* provided in the hydraulic supply and discharge pipes 55*a*, 55*b*.

The hydraulic cylinder mechanism 28 for the upper backup roll 18 is composed of the two hydraulic cylinders, but may be composed of one hydraulic cylinder. Also, the hydraulic pump 44 is shared between the hydraulic cylinder mechanism 24 for the upper work roll 14 and the hydraulic cylinder mechanism 28 for the upper backup roll 18, but the hydraulic pumps 44 may be provided separately. The contraction portions 46, 56*a*, 56*b* have nearly the same structure, and have an opening area which is 0.01 to 0.1% of the cylinder cross-sectional area of each hydraulic cylinder in order to maintain the roll position control speed at a conventional level and improve dynamic stiffness.

The hydraulic cylinder mechanisms 24, 28 have been described above, while the hydraulic cylinder mechanisms 32, 36 also have the same structure. The structure of the contraction portions 46, 56*a*, 56*b* is not limited to that described above, and their lengths may be determined such that the deformation stiffness of the orifice is sufficiently greater than the oil stiffness.

Figure 3:
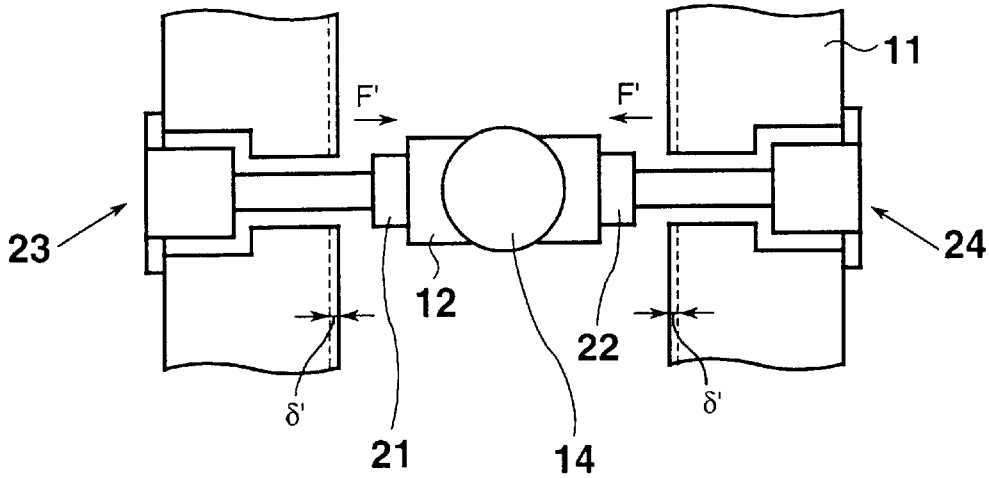
FIGS. 3(*a*) and 3(*b*) are schematic views for illustrating actions of the thrust mechanism for the upper work roll.
Figure 3:
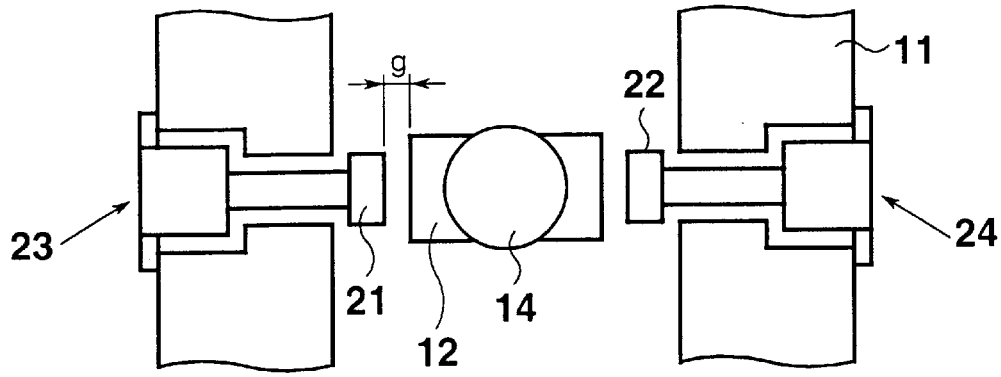
Figure 4:
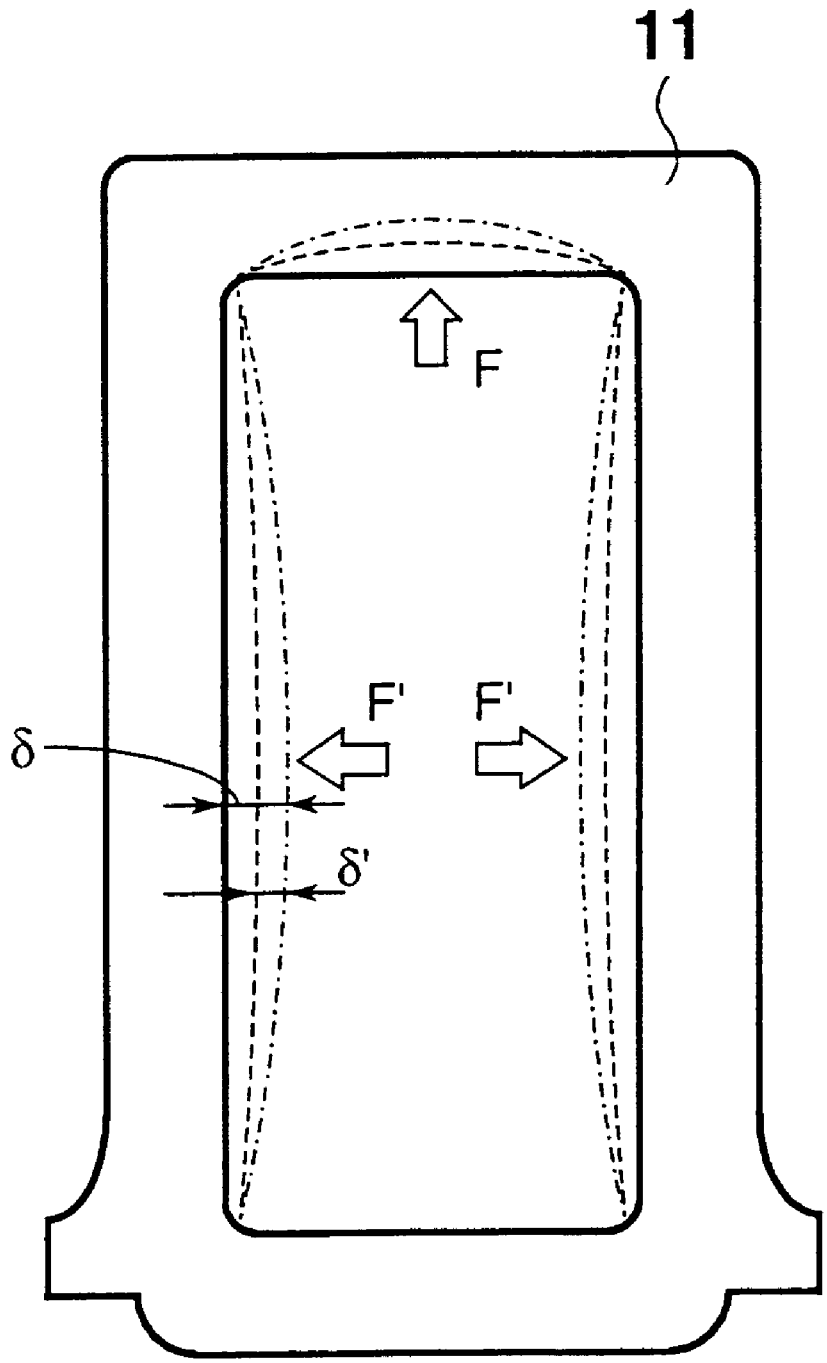
FIG. 4 is an explanation drawing showing stress acting on a housing during roll.

Thus, when rolling is performed, a strip S is fed from the entry side of the housing 11, and passed between the upper work roll 14 and the lower work roll 15 given a predetermined load by the screw down device 20, whereby the strip S is rolled. The rolled strip S is delivered from the delivery side and supplied to a subsequent step. At this time, the housing 11 generates an inward narrowing deformation amount $\delta$ in response to a screw down load F, as shown in FIG. 3(*a*) and FIG. 4. According to the present embodiment, however, during rolling of the strip S, a thrust force F' is exerted on the housing 11 by actuating the screw mechanisms 23, 27, 31, 35 and the hydraulic cylinder mechanisms 24, 28, 32, 36, whereupon the deformation amount δ of the housing 11 is decreased by δ'. Thus, even if the roll chock 12 is displaced by δ', no gap occurs between the roll chock 12 and the housing 11. As a result, the horizontal dynamic stiffness of the rolling mill is kept high. Even when rolling is performed in this state with a high rolling force and a high percentage reduction in the thickness of the strip, great mill vibrations probably attributed to, for example, friction between the strip S being rolled and the work rolls 14, 15 do not occur in the housing 11 or the work rolls 14, 15, thus permitting high efficiency rolling. Furthermore, hysteresis during control of the work rolls 14, 15 and backup rolls 18, 19 in the up-and-down direction can be reduced to an unproblematic value by controlling the pressing force appropriately.

When roll replacement is to be performed, as shown in FIG. 3(*b*), the crossheads 21, 22, 25, 26, 29, 30, 33, 34 are separated from the chocks 12, 13, 16, 17 upon positional adjustment by the screw mechanisms 23, 27, 31, 35 and hydraulic cylinder mechanisms 24, 28, 32, 36, thereby forming gaps g therebetween. Thus, the crossheads 21, 22, 25, 26, 29, 30, 33, 34 are opened, and the upper and lower work rolls 14, 15 and backup rolls 18, 19 can be withdrawn from the work side by a predetermined device, and replaced with new ones.

Figure 5:
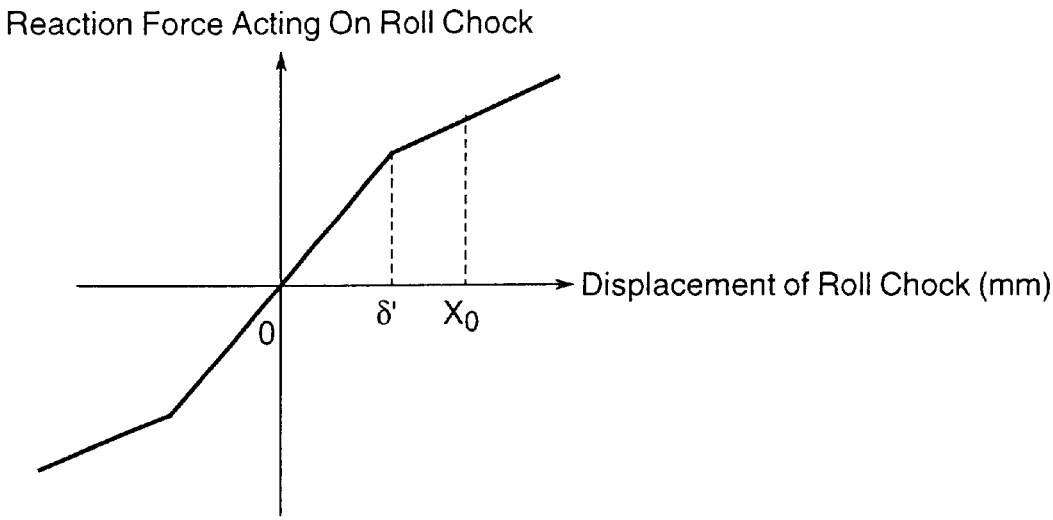
FIGS. 5(*a*) and 5(*b*) are graphs showing a roll chock reaction force responsive to roll chock displacement.
Figure 5:
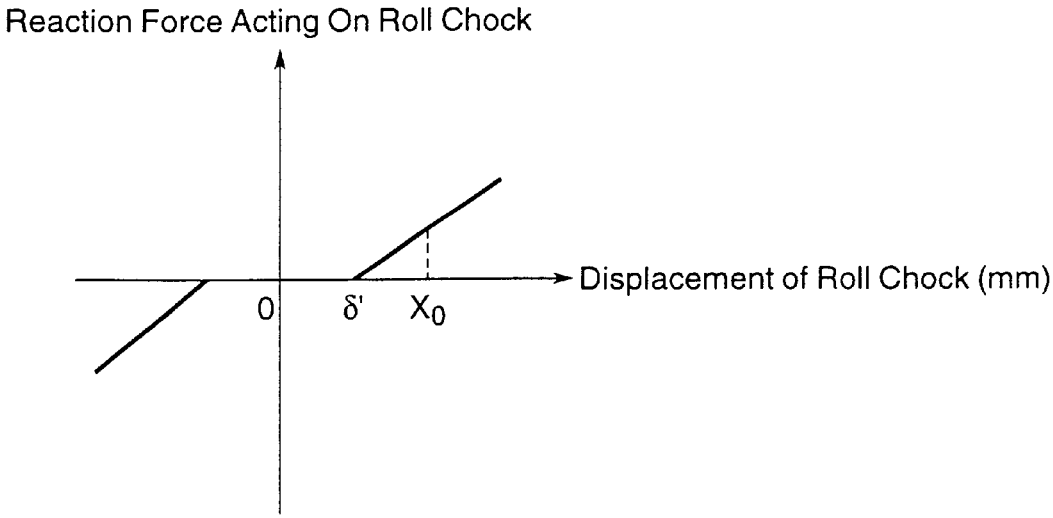

In the cross rolling mill of the present embodiment, during rolling of the strip S, the pressing force F' is exerted on the housing 11 by the screw mechanisms 23, 27, 31, 35 and hydraulic cylinder mechanisms 24, 28, 32, 36 in response to the screw down load F acting on the housing 11. Thus, the deformation amount of the housing 11 is δ−δ'. Graphs shown in FIGS. 5(*a*), 5(*b*) and 6 reveal the relationship between the horizontal displacement of the roll chock and the horizontal reaction force of the housing against the roll chock. The gradient of the graph shows horizontal dynamic stiffness. Assume here that the roll chock is pressed with the pressing force F' and the deformation amount δ' of the housing is positive, as shown in FIG. 5(*a*). When the roll chock displacement exceeds δ' in the presence of an external force, etc. during rolling, stiffness from the housing post in a direction opposite to the direction x of displacement cannot be considered, and the gradient (stiffness) decreases. In other words, effective horizontal dynamic stiffness is determined by a vibration amplitude ratio $\eta=x_0/\delta'$ with the horizontal amplitude of roll vibrations as $x_0$. The greater η (the greater $x_0$, or the smaller δ'), the lower the effective horizontal dynamic stiffness becomes. Assume, on the other hand, that the roll chock is not pressed with the pressing force F' and the deformation amount δ' of the housing is zero or a gap exists between the roll chock and the housing (δ' is negative), as shown in FIG. 5(*b*). In this case, effective horizontal dynamic stiffness is determined by a vibration amplitude ratio $\eta=x_0/\delta'$ with the horizontal amplitude of roll vibrations as $x_0$. The greater η, the higher the effective horizontal dynamic stiffness becomes.

Figure 6:
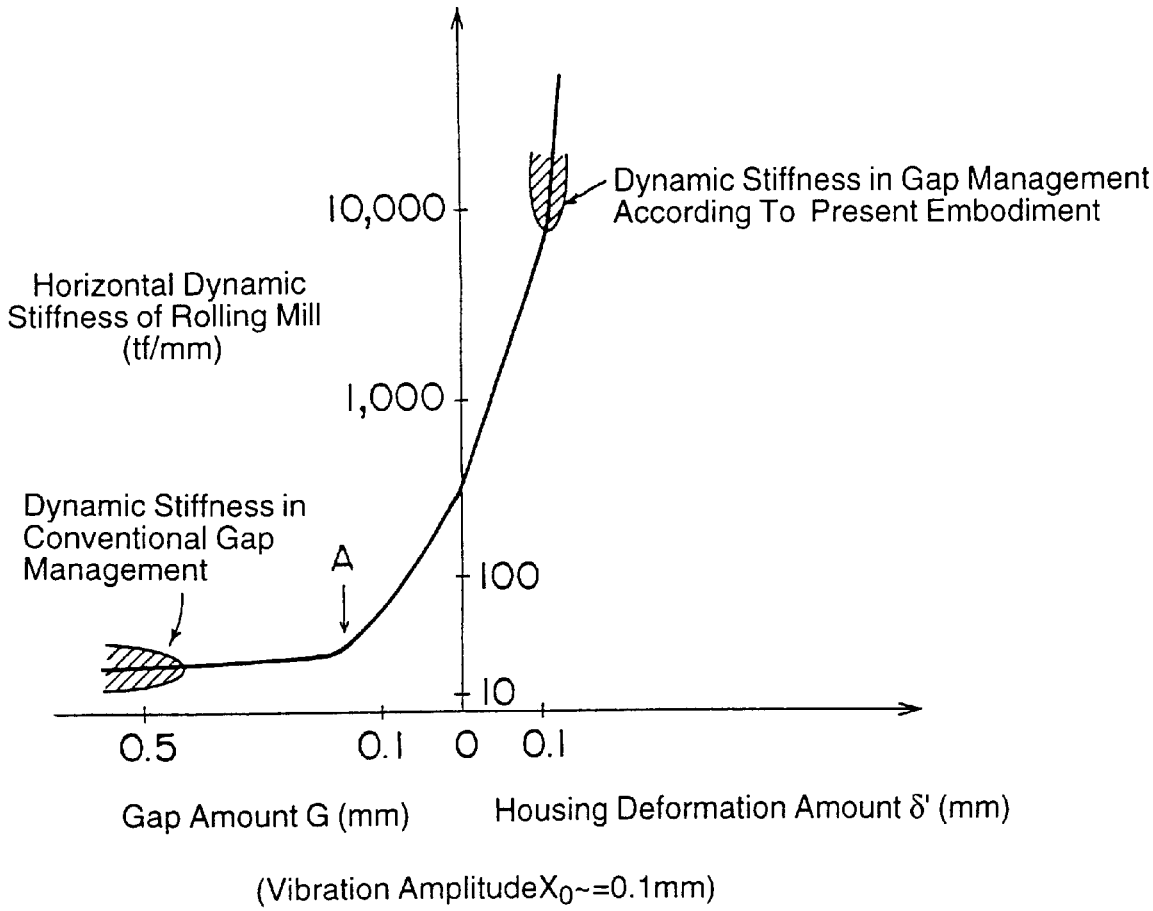
FIG. 6 is a graph showing horizontal dynamic stiffness versus gap amounts and housing deformation amounts.

As shown in FIG. 6, the relationship between the gap amount G or housing deformation amount δ' and horizontal dynamic stiffness is evaluated, with the horizontal amplitude of vibrations of the roll chock as $x_0$ of ~0.1 mm. In the conventional region of gap management, rolling performed with a high rolling force and a high percentage reduction in the thickness of the strip causes vibrations to the work roll. When the gap amount G is larger than the horizontal amplitude $x_0$ (leftward of the point A in FIG. 6), the roll chock contacts only the housing post on either the entry side or the delivery side, so that horizontal dynamic stiffness is low and levels off. According to the present embodiment, the gap amount G is controlled by use of the hydraulic cylinder having the contraction portion. Thus, an oil is filled into the cylinder to increase stiffness and simultaneously gain a pressure loss at the contraction portion, thereby increasing damping. When the gap amount G decreases (rightward of the point A in FIG. 6), the roll chock contacts the housing post on both of the entry side and the delivery side during vibrations of the roll chock, thus increasing horizontal dynamic stiffness. Also, horizontal dynamic stiffness is increased owing to resistance of the contraction portion. In this manner, the roll chocks are pressed against the housing by the hydraulic cylinders having the contraction portions, whereby the horizontal deformation amount of the housing can be managed by use of the pressing force F'. Thus, horizontal dynamic stiffness during rolling can be markedly increased over earlier technologies, and occurrence of vibrations during rolling can be lessened.

Figure 7:
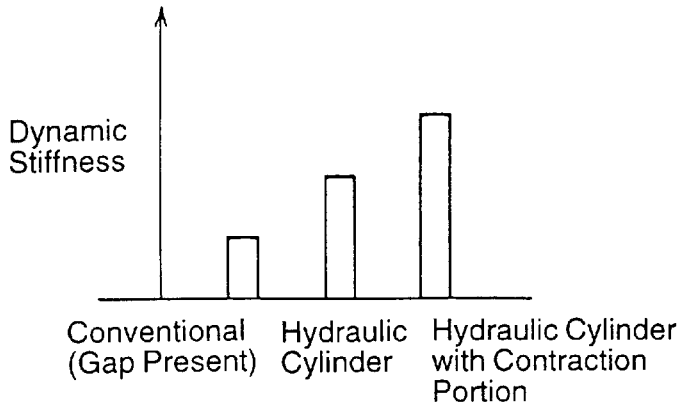
FIGS. 7(*a*) to 7(*c*) are graphs showing a comparison of horizontal dynamic stiffness under respective conditions.
Figure 7:
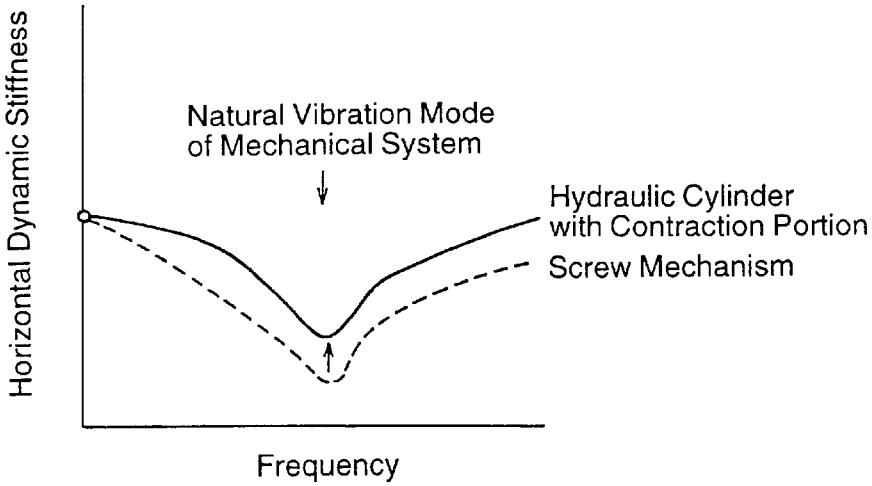
Figure 7:
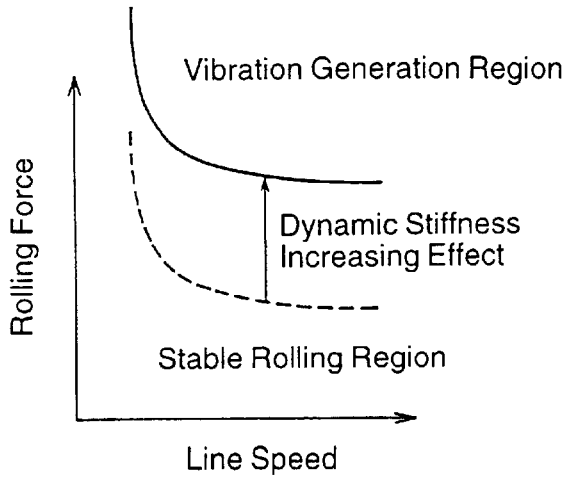

In a comparison of horizontal dynamic stiffness data on the conventional screw mechanism and the hydraulic cylinder having the contraction portion according to the present embodiment, the present embodiment is found to increase horizontal dynamic stiffness in comparison with the conventional technology by increasing damping, as shown in FIG. 7(*a*). As shown in FIG. 7(*b*), let us take an example in which the gap amount G=1.0 mm, and initial strain=0.2 mm. When horizontal dynamic stiffness increases, reduction or prevention of vibrations at the rolling stage can be achieved for the following reasons: If vibrations are forced vibrations between the roll and the strip due to the external force F, vibration amplitude at the resonance point is expressed as $x=F/2K\zeta$ where K is modal stiffness of a resonance mode, ζ is an amount called a damping ratio, and 2Kζ is an amount defined as dynamic stiffness. When the external force F is constant, the amplitude decreases in inverse proportion to dynamic stiffness. In short, it is explained that as dynamic stiffness increases, amplitude decreases. When vibrations are self-excited vibrations, vibrations occur in case the magnitude of excitation $P>2K\zeta$ is satisfied. This means that as dynamic stiffness increases, a region with 2Kζ widens, broadening a stable rolling region where no vibrations occur. Thus, the stable rolling region is broadened by the increase in dynamic stiffness, as shown in FIG. 7(*c*).

In the above-described embodiment, the four high cross rolling mill is used as the rolling mill of the present invention, and described as a separate crosshead type. However, this structure is not limitative.

[Second Embodiment]

Figure 8:
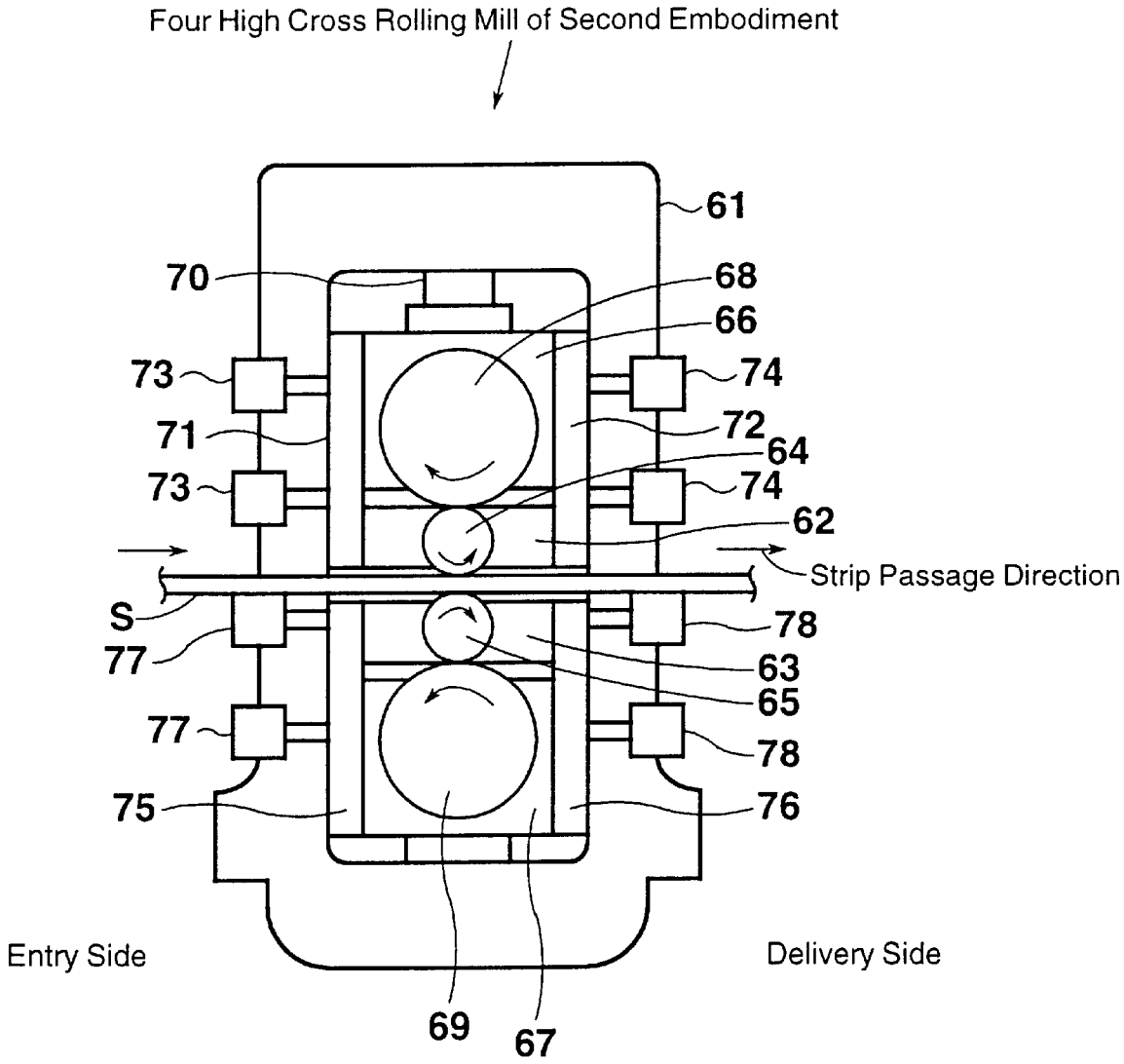
FIG. 8 is a schematic view of a cross rolling mill as a rolling mill according to a second embodiment of the present invention.

In a cross rolling mill according to a second embodiment, as shown in FIG. 8, upper and lower work rolls 64 and 65 are rotatably supported by upper and roller work roll chocks 62 and 63 as a pair supported by a housing 61. Upper and lower backup rolls 68 and 69 are rotatably supported by upper and lower backup roll chocks 66 and 67 as a pair supported by the housing 61. A screw down device 70 for imposing a rolling load is provided in an upper portion of the housing 61. Upper crossheads 71 and 72 for supporting the upper roll chocks 62 and 66 are provided on an entry side and a delivery side of the housing 61. The upper crossheads 71 and 72 are horizontally movable by a screw mechanism 73 and a hydraulic cylinder mechanism 74. On the other hand, lower crossheads 75 and 76 for supporting the lower roll chocks 63 and 67 are provided on the entry side and the delivery side of the housing 61. The lower crossheads 75 and 76 are horizontally movable by a screw mechanism 77 and a hydraulic cylinder mechanism 78.

The hydraulic cylinder mechanism 74 or 78 is composed of a cylinder fixed to the housing 61, a piston connected to the crosshead 72 or 76 via a rod and movable in the cylinder, a hydraulic pump, a hydraulic supply and discharge pipe connecting the hydraulic pump and the cylinder, and a contraction portion provided in the hydraulic supply and discharge pipe, although these members are not illustrated in the same manner as in the aforementioned embodiment.

Thus, when rolling is performed, a strip S is fed from the entry side of the housing 61, and passed between the upper work roll 64 and the lower work roll 65 under a predetermined load by the screw down device 70, whereby the strip S is rolled. The rolled strip S is delivered from the delivery side and supplied to a subsequent step. At this time, the housing 61 generates an inward narrowing deformation amount δ in response to a screw down load F. However, a pressing force F' is exerted on the housing 61 by actuating the screw mechanisms 73, 77 and the hydraulic cylinder mechanisms 74, 78, whereupon the deformation amount δ of the housing 61 is decreased by δ'. Thus, the horizontal dynamic stiffness of the rolling mill is increased. Even when rolling is performed in this state with a high rolling force and a high percentage reduction in the thickness of the strip, great mill vibrations probably attributed to, for example, friction between the strip S being rolled and the work rolls 64, 65 do not occur in the housing 61 or the work rolls 64, 65, thus permitting high efficiency rolling.

[Third Embodiment]

Figure 9:
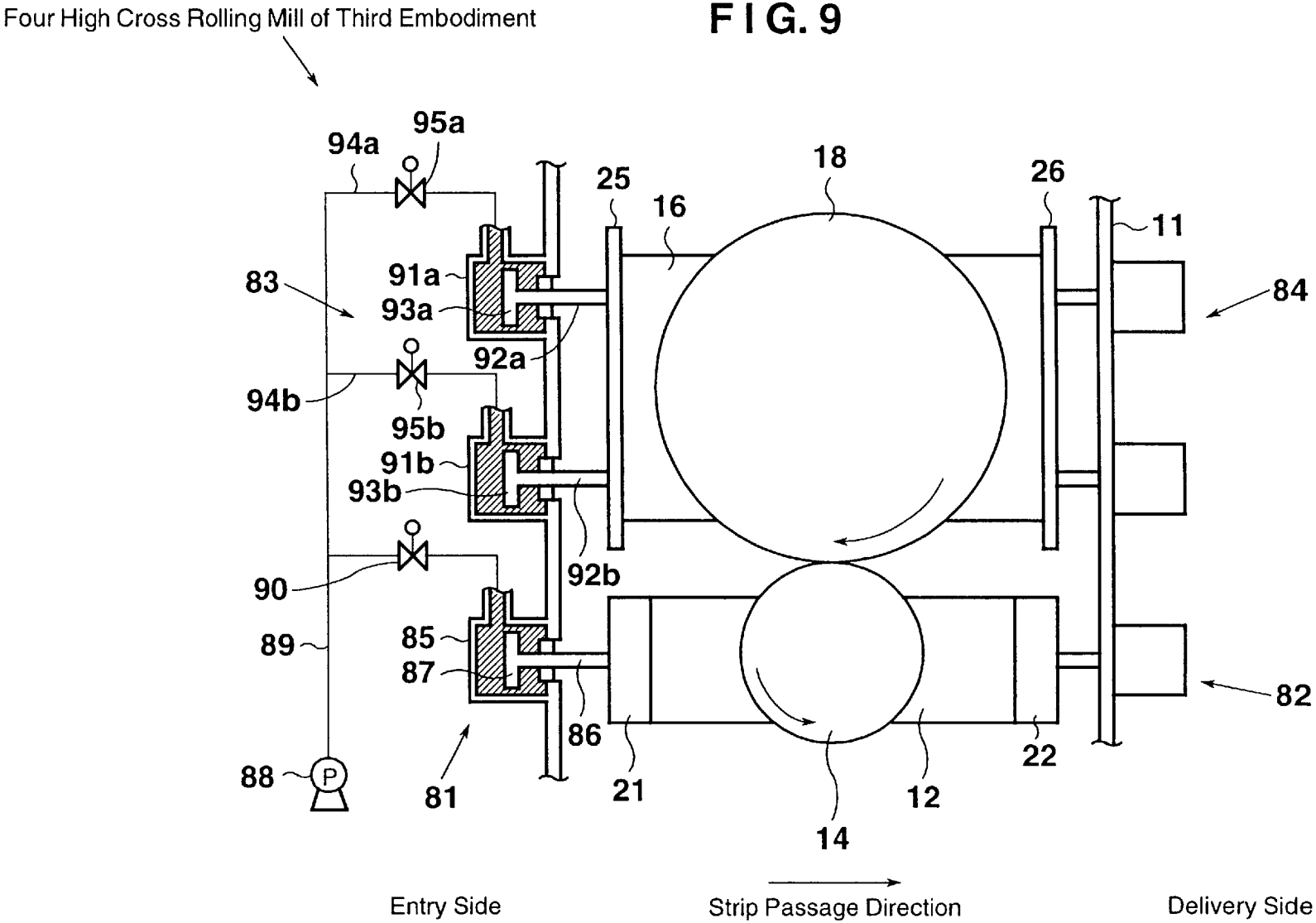
FIG. 9 is a schematic view of thrust mechanisms of a cross rolling mill as a rolling mill according to a third embodiment of the present invention.

In a cross rolling mill according to a third embodiment, as shown in FIG. 9, an upper work roll 14 is rotatably supported by an upper work roll chock 12. The upper work roll chock 12 is horizontally movably supported by upper crossheads 21 and 22 on an entry side and a delivery side. The upper crosshead 21 on the entry side is movable by a hydraulic cylinder mechanism 81, while the upper crosshead 22 on the delivery side is movable by a screw mechanism 82. An upper backup roll 18 is rotatably supported by an upper backup roll chock 16. The upper backup roll chock 16 is horizontally movably supported by upper crossheads 25 and 26 on an entry side and a delivery side. The upper crosshead 25 on the entry side is movable by a hydraulic cylinder mechanism 83, while the upper crosshead 26 on the delivery side is movable by a screw mechanism 84. A lower work roll and a lower backup roll are also structured similarly.

The hydraulic cylinder mechanism 81 is composed of a cylinder 85 fixed to a housing 11, a piston 87 connected to the upper crosshead 21 via a rod 86 and movable in the cylinder 81, a hydraulic pump 88, a hydraulic supply and discharge pipe 89 connecting the hydraulic pump 88 and the cylinder 85, and an electromagnetic valve 90 provided in the hydraulic supply and discharge pipe 89 and constituting a contraction portion. Likewise, the hydraulic cylinder mechanism 83 is composed of a pair of cylinders 91*a* and 91*b*, pistons 93*a*, 93*b* connected to the upper crosshead 25 via rods 92*a*, 92*b*, the hydraulic pump 88, hydraulic supply and discharge pipes 94*a*, 94*b* connecting the hydraulic pump 88 and the cylinders 91*a*, 91*b*, and electromagnetic valves 95*a*, 95*b* provided in the hydraulic supply and discharge pipes 94*a*, 94*b* and each constituting a contraction portion.

During rolling, therefore, a horizontal pressing force is exerted on the housing 11 by the hydraulic cylinder mechanisms 81, 83 and screw mechanisms 82, 84. In combination with an inward narrowing deformation amount of the housing 11 responsive to a screw down load, the horizontal dynamic stiffness of the rolling mill increases. Even when rolling is performed in this state with a high rolling force and a high percentage reduction in the thickness of the strip, great vibrations do not occur, thus permitting high efficiency rolling. In this case, the electromagnetic valves 90, 95*a*, 95*b* are actuated in a closing direction, whereupon the hydraulic cylinder mechanisms have their contraction portions active, to control a gap amount G. Thus, an oil is filled into the cylinder to increase stiffness and simultaneously gain a pressure loss at the contraction portion, thereby increasing damping. In this manner, the horizontal deformation amount of the housing 11 can be managed by use of the pressing force. Thus, horizontal dynamic stiffness during rolling can be markedly increased over earlier technologies, and occurrence of vibrations during rolling can be lessened. When the cross angle between the work rolls 14 and 15 and backup rolls 18 and 19 is to be set at a required angle, the hydraulic cylinder mechanisms 81, 83 and screw mechanisms 82, 84 are synchronously actuated. At this time, the hydraulic cylinder mechanisms 81, 83 are actuated in a state in which the electromagnetic valves 90, 95*a*, 95*b* are actuated in a fully opening direction to eliminate the contraction portions. Thus, flow of a working fluid in the hydraulic supply and discharge pipes 89, 94*a*, 94*b* is smoothed, so that the contraction portions (electromagnetic valves 90, 95*a*, 95*b*) do not impede the setting of the cross angle.

In the present embodiment, the electromagnetic valves 90, 95*a*, 95*b* are provided in the hydraulic cylinder mechanisms 81, 83 to form the contraction portions, but manually operated valves may be adopted. Furthermore, the electromagnetic valves 90, 95*a*, 95*b* of the hydraulic cylinder mechanisms 81, 83 are actuated in the closing direction during rolling to serve as the contraction portions, and they are fully opened when setting the roll cross angle. However, vibrations occurring during rolling may be measured, and the opening or closing position of the electromagnetic valves 90, 95*a*, 95*b* may be adjusted in accordance with the vibrations, whereby the diameters of the contraction portions adapted for the magnitude of vibrations may be provided.

[Fourth Embodiment]

Figure 10:
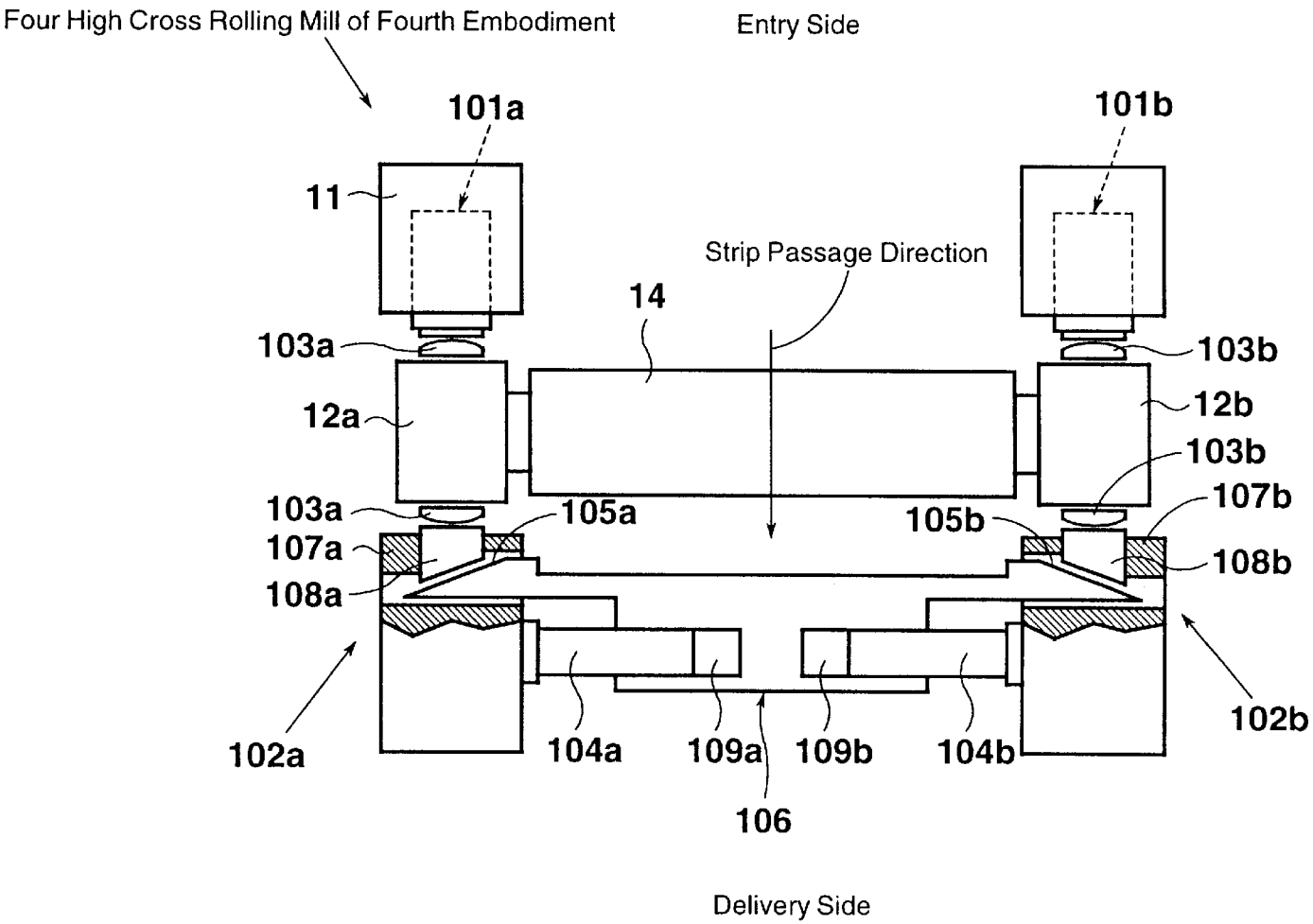
FIG. 10 is a schematic plan view of thrust mechanisms of a cross rolling mill as a rolling mill according to a fourth embodiment of the present invention.

In a cross rolling mill according to a fourth embodiment, as shown in FIG. 10, upper work roll chocks 12*a* and 12*b* on the right and left of an upper work roll 14 are horizontally movable by hydraulic cylinder mechanisms 101*a*, 101*b* disposed on an entry side and wedge mechanisms (mechanical thrust means) 102*a*, 102*b* disposed on a delivery side. Semi-round liners 103*a*, 103*b* are interposed between the work roll chocks 12*a*, 12*b*, the hydraulic cylinder mechanisms 101*a*, 101*b* and the wedge mechanisms 102*a*, 102*b*. A similar structure is provided for a lower work roll. The hydraulic cylinder mechanisms 101*a*, 101*b* each have a cylinder, a piston, a hydraulic pump, a hydraulic supply and discharge pipe, and a contraction portion, as in the aforementioned embodiments. The wedge mechanisms 102*a* and 102*b* are composed of left and right cylinder rods 104*a* and 104*b* as a pair having one end portion coupled to a housing 11, a crossing wedge 106 having inclined surfaces 105*a* and 105*b* formed in left and right end portions thereof and having the other end portions of the cylinder rods 104*a* and 104*b* movably fitted thereto and thus being supported so as to be movable along an axial direction of the work roll 14, and wedge liners 108*a* and 108*b* supported between the liners 103*a* and 103*b* and the inclined surfaces 105*a* and 105*b* of the crossing wedge 106 movably along a direction perpendicular to the axial direction of the work roll 14 by wedge liner guides 107*a* and 107*b* fixed to both sides of the housing 11.

Thus, when the cross angle of the work roll 14 is to be set, the hydraulic cylinder mechanisms 101*a*, 101*b* and the wedge mechanisms 102*a*, 102*b* are actuated synchronously. At this time, the wedge mechanisms 102*a*, 102*b* are actuated by supplying a hydraulic pressure to one of oil chambers 109*a* and 109*b* to move the crossing wedge 106 to one side, thereby thrusting the wedge lines 108*a*, 108*b* via the inclined surfaces 105*a*, 105*b* and thus moving the work roll chocks 12*a*, 12*b*. During rolling, on the other hand, a horizontal pressing force is exerted on the housing 11 by the hydraulic cylinder mechanisms 101*a*, 101*b* and wedge mechanisms 102*a*, 102*b*. As a result, the inward narrowing deformation amount of the housing 11 responsive to a screw down load decreases, and the horizontal dynamic stiffness of the rolling mill increases. Even when rolling is performed in this state with a high rolling force and a high percentage reduction in the thickness of the strip, great vibrations do not occur, thus permitting high efficiency rolling. At this time, in the wedge mechanisms 102*a*, 102*b*, the cross angle of the work roll 14 is determined by the crossing wedge 106, so that positioning with high accuracy becomes possible.

[Fifth Embodiment]

Figure 11:
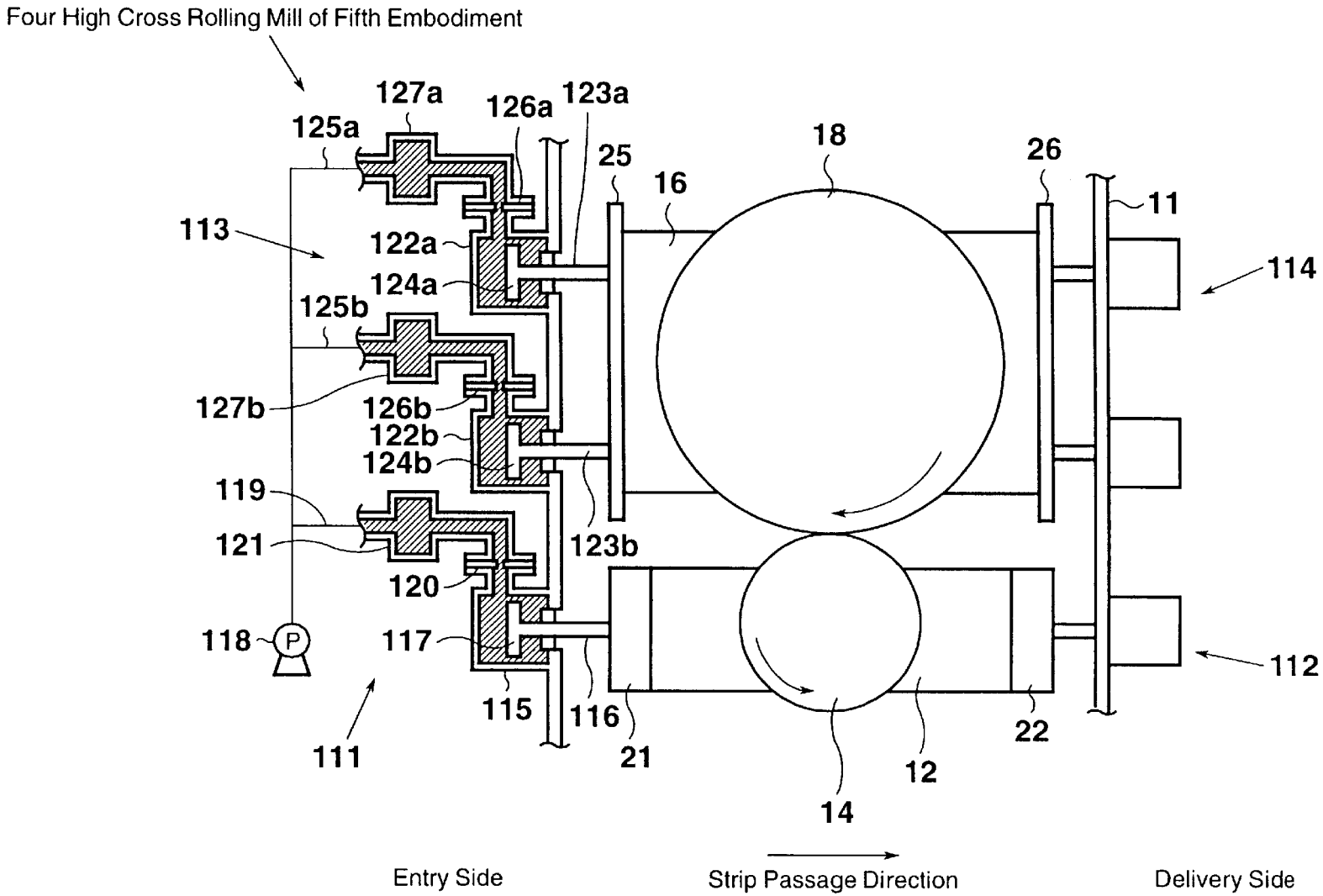
FIG. 11 is a schematic view of thrust mechanisms of a cross rolling mill as a rolling mill according to a fifth embodiment of the present invention.

In a cross rolling mill according to a fifth embodiment, as shown in FIG. 11, an upper crosshead 21 on an entry side in an upper work roll 14 is movable by a hydraulic cylinder mechanism 111, while an upper crosshead 22 on a delivery side is movable by a screw mechanism 112. An upper crosshead 25 on an entry side in an upper backup roll 18 is movable by a hydraulic cylinder mechanism 113, while a crosshead 26 on a delivery side is movable by a screw mechanism 114. A lower work roll and a lower backup roll are also structured similarly.

The hydraulic cylinder mechanism 111, as in the aforementioned embodiments, is composed of a cylinder 115, a piston 117 connected to a rod 116, a hydraulic pump 118, and a hydraulic supply and discharge pipe 119, and a contraction portion 120 and an enlarged portion 121 are provided in the hydraulic supply and discharge pipe 119. Likewise, the hydraulic cylinder mechanism 113 is composed of a pair of cylinders 122*a* and 122*b*, pistons 124*a*, 124*b* connected to rods 123*a*, 123*b*, and hydraulic supply and discharge pipes 125*a*, 125*b*. Contraction portions 126*a*, 126*b* and enlarged portions 127*a*, 127*b* are provided in the hydraulic supply and discharge pipes 125*a*, 125*b*.

Thus, when the cross angle of the work roll 14 is to be set, the hydraulic cylinder mechanisms 111, 113 and the screw mechanisms 112, 114 are actuated synchronously. In this case, a hydraulic pressure is supplied and discharged from the hydraulic pump 118 via the hydraulic supply and discharge pipes 119, 125*a*, 125*b*. During rolling, pressure changes responsive to hydraulic cylinder changes according to mill vibrations occur in the supply and discharge pipes. If the frequency of a pressure wave as an excitation source becomes close to columnar resonance frequency, a resonance phenomenon may occur. This columnar resonance frequency f can be calculated from the following equation:

$$f=(C/2L)\cdot n$$

where L is the length of piping (the length from the hydraulic pump 118 to the contraction portion 120, 126*a* or 126*b*), c is the sound velocity, and n is mode. If the length of the piping is shortened, the columnar resonance frequency f can be made higher than the natural value of mill vibrations targeted, and resonance can be avoided. With a rolling mill, however, the length of piping from the hydraulic source (hydraulic pump) to the hydraulic cylinder mechanism is determined beforehand, and is difficult to shorten.

Figure 12:
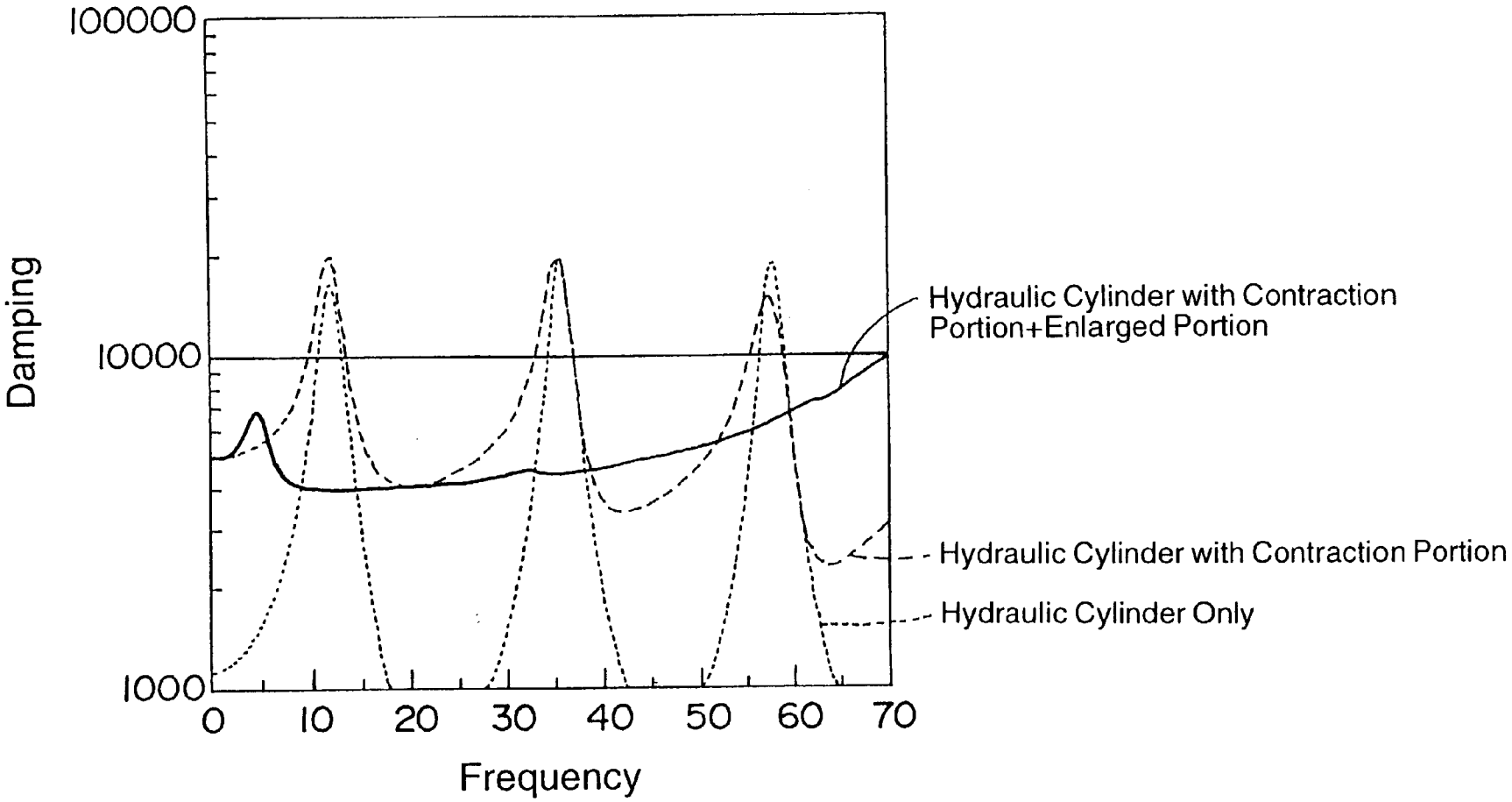
FIG. 12 is a graph showing the damping effect of the cross rolling mill as the fifth embodiment on vibrations.

According to the present embodiment, therefore, the enlarged portions 121, 127*a*, 127*b* are provided in the hydraulic supply and discharge pipes 119, 125*a*, 125*b*. FIG. 12 shows the relationship between the pressure wave frequency and damping capacity under various conditions. According to FIG. 12, when only the hydraulic cylinder is used, resonance points with high damping occur, while antiresonance points with extremely low damping capacity occur. The occurrence of such extremely low damping capacity induces decreases in dynamic stiffness, and poses a major problem in controlling vibrations.

In the present embodiment, as stated above, the enlarged portions 121, 127*a*, 127*b* as well as the contraction portions 120, 126*a*, 126*b* are provided in the hydraulic supply and discharge pipes 119, 125*a*, 125*b*. By this measure, resonance points are avoided to eliminate antiresonance points with low damping capacity and ensure the necessary damping capacity at any frequencies. In the presence of only the contraction portions, the enlarged portions need not be provided, if there is sufficient damping in the targeted pressure wave frequency region.

As described in the above embodiments, one of the entry side thrust means and the delivery side thrust means for roll crossing the upper and lower work rolls 14 and 15 is the screw mechanisms or wedge mechanisms which are mechanical thrust means, while the other of the entry side thrust means and the delivery side thrust means is hydraulic cylinder mechanisms which are hydraulic thrust means, and the contraction portions are provided in the hydraulic supply and discharge pipes of the hydraulic cylinder mechanisms. By so doing, horizontal dynamic stiffness is increased to suppress vibrations. It is preferred that the rolling mill of the present invention, which involves these features, be applied to hot rolling. That is, in hot rolling, a strip heated to a high temperature is engaged between upper and lower work rolls at a high speed and rolled thereby. Thus, the impact force during engagement of the strip between the work rolls is higher than in cold rolling. In addition, the number of times the impact force is exerted is large, and the rolling amount (rolling force) of the strip is great. Thus, vibrations encountered this time can be effectively suppressed by applying the rolling mill of the present invention.

In the above embodiments, moreover, the screw mechanisms are provided as mechanical thrust means for the work roll and backup roll on the entry side, and the hydraulic cylinder mechanisms are provided as the hydraulic thrust means for the work roll and backup roll on the delivery side. Alternatively, the hydraulic cylinder mechanisms are provided as the hydraulic thrust means on the entry side, and the screw mechanisms are provided on the delivery side. Any of these features may be adopted, and wedge mechanisms may be used as the mechanical thrust means. In actuality, the backup roll is offset relative to the work roll upstream in the transport direction of the strip. Thus, it is desirable that mechanical thrust means be disposed on the delivery side of the work roll, and mechanical thrust means be disposed on the entry side of the backup roll. Besides, both the mechanical thrust means and the hydraulic thrust means are provided for the work roll and the backup roll, but they may be provided for the work roll only.

In the above-mentioned embodiments, the rolling mill of the present invention is described as being applied as a cross rolling mill, but may be applied as other type of rolling mill.

[Sixth Embodiment]

Figure 13:
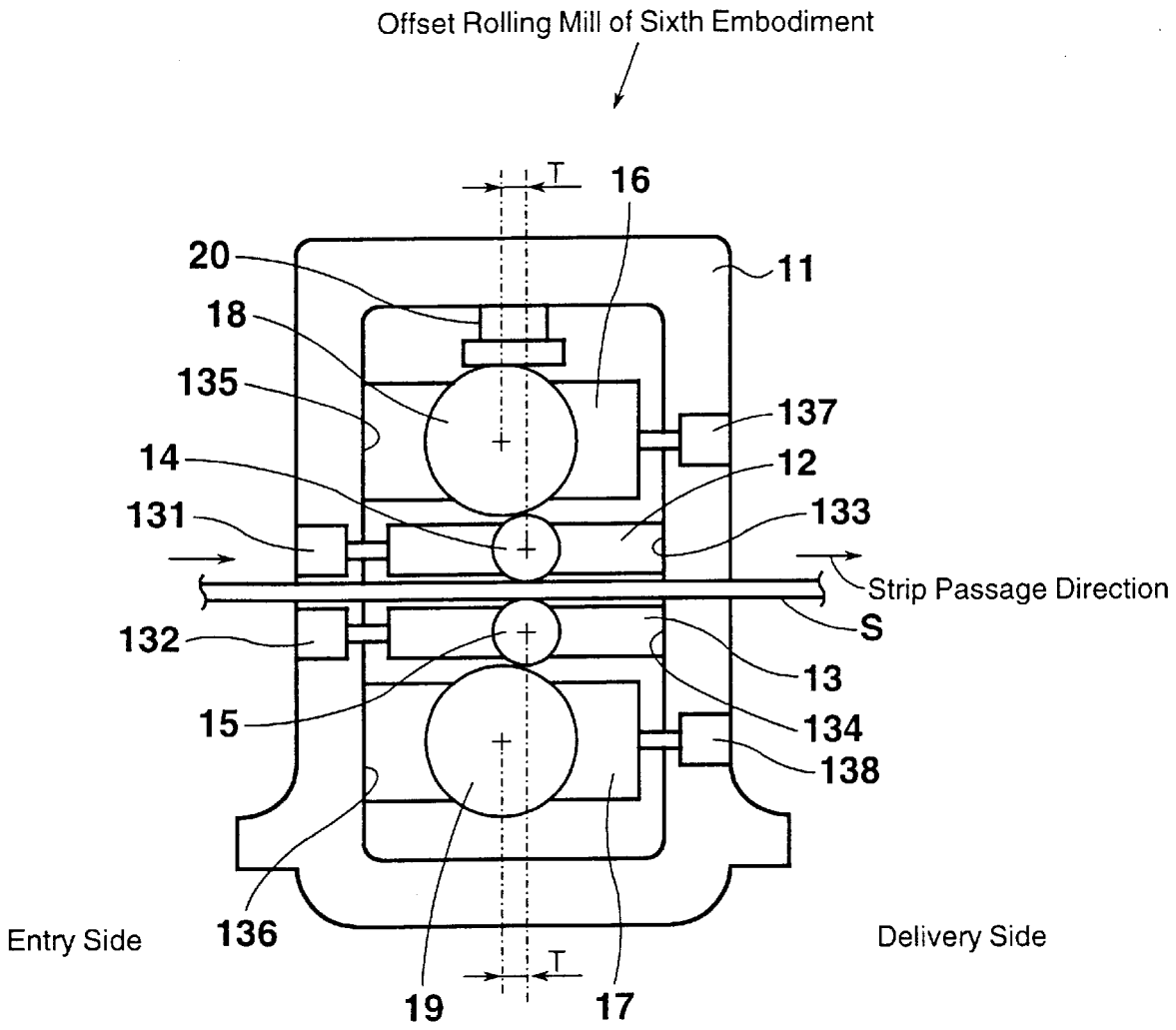
FIG. 13 is a schematic view of an offset rolling mill as a rolling mill according to a sixth embodiment of the present invention.

A rolling mill according to a sixth embodiment is an offset rolling mill in which upper and lower backup rolls are slightly displaced relative to upper and lower work rolls rearward in the transport direction of the strip. In this offset rolling mill, as shown in FIG. 13, upper and lower work rolls 14 and 15 are rotatably supported by work roll chocks 12 and 13. The work roll chocks 12, 13 have an entry side supported so as to be capable of being thrust by hydraulic cylinder mechanisms 131, 132, and have a delivery side supported by housing liner portions 133, 134 of a housing 11. Upper and lower backup rolls 18 and 19 are rotatably supported by backup roll chocks 16 and 17. The backup roll chocks 16, 17 have an entry side supported by housing liner portions 135, 136, and have a delivery side supported so as to be capable of being thrust by hydraulic cylinder mechanisms 137, 138. In this case, the work rolls 14, 15 and the backup rolls 18, 19 are offset relative to each other by T in the direction of passage of the strip. The hydraulic cylinder mechanisms 131, 132, 137, 138 are mounted on the housing 11, and each have a contraction portion (not shown). The housing liner portions 133, 134, 135, 136 horizontally support the roll chocks 12, 13, 16, 17 in cooperation with the pressing force of the hydraulic cylinder mechanisms 131, 132, 137, 138.

During rolling, therefore, a horizontal pressing force is exerted by thrusting the roll chocks 12, 13, 16, 17 against the housing liner portions 133, 134, 135, 136 of the housing 11 by the hydraulic cylinder mechanisms 131, 132, 137, 138. This horizontal pressing force, coupled with an inward narrowing deformation amount of the housing 11 responsive to a screw down load, increases the horizontal dynamic stiffness of the rolling mill. Even when rolling is performed in this state with a high rolling force and a high percentage reduction in the thickness of the strip, great vibrations do not occur, thus permitting high efficiency rolling. Moreover, the hydraulic cylinder mechanisms having their contraction portions control a gap amount G. For this purpose, an oil is filled into the cylinder to increase stiffness and simultaneously gain a pressure loss at the contraction portion, thereby increasing damping. In this manner, horizontal dynamic stiffness during rolling can be increased, and occurrence of vibrations during rolling can be lessened.

[Seventh Embodiment]

Figure 14:
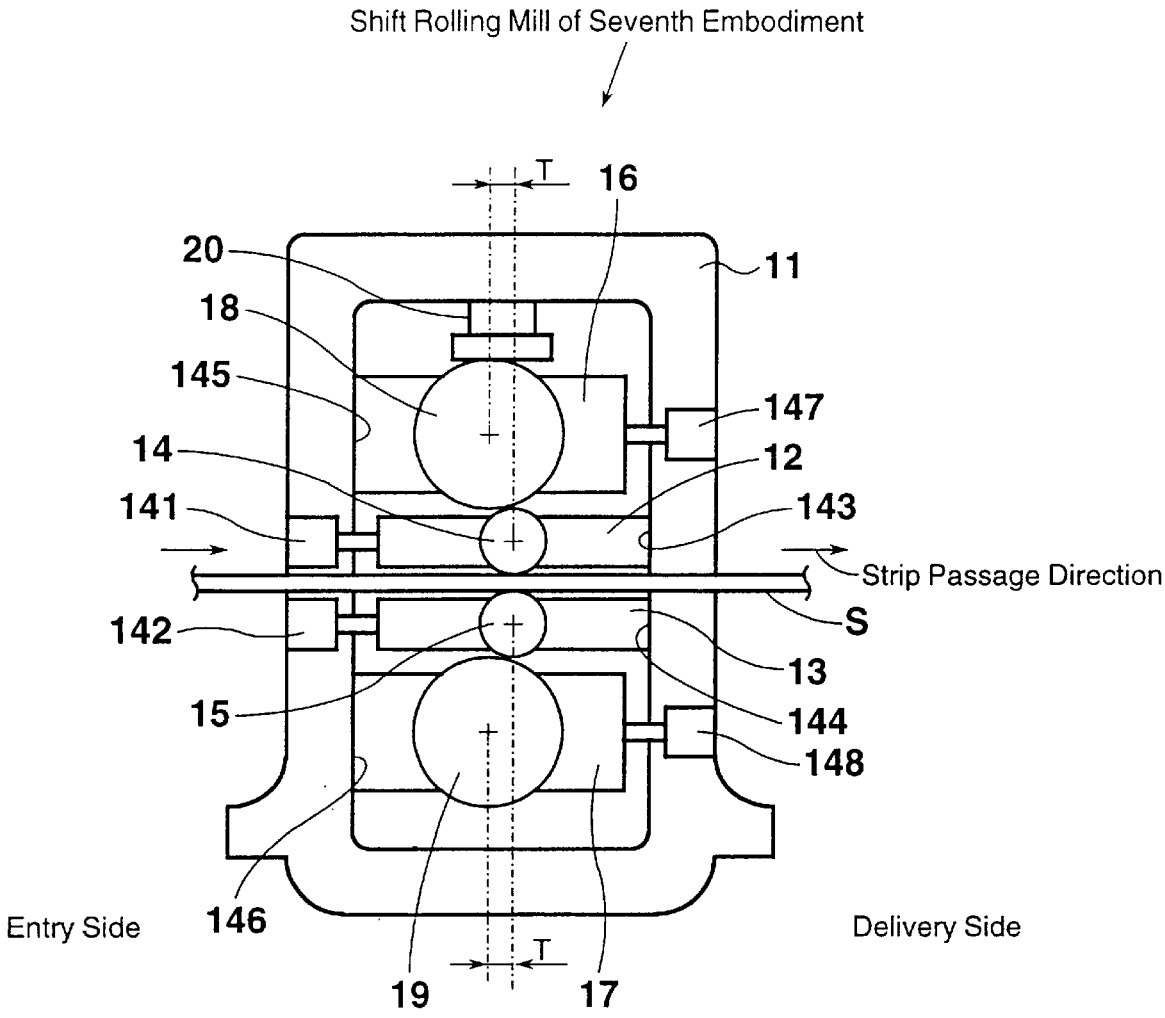
FIG. 14 is a schematic view of a shift rolling mill as a rolling mill according to a seventh embodiment of the present invention.
Figure 15:
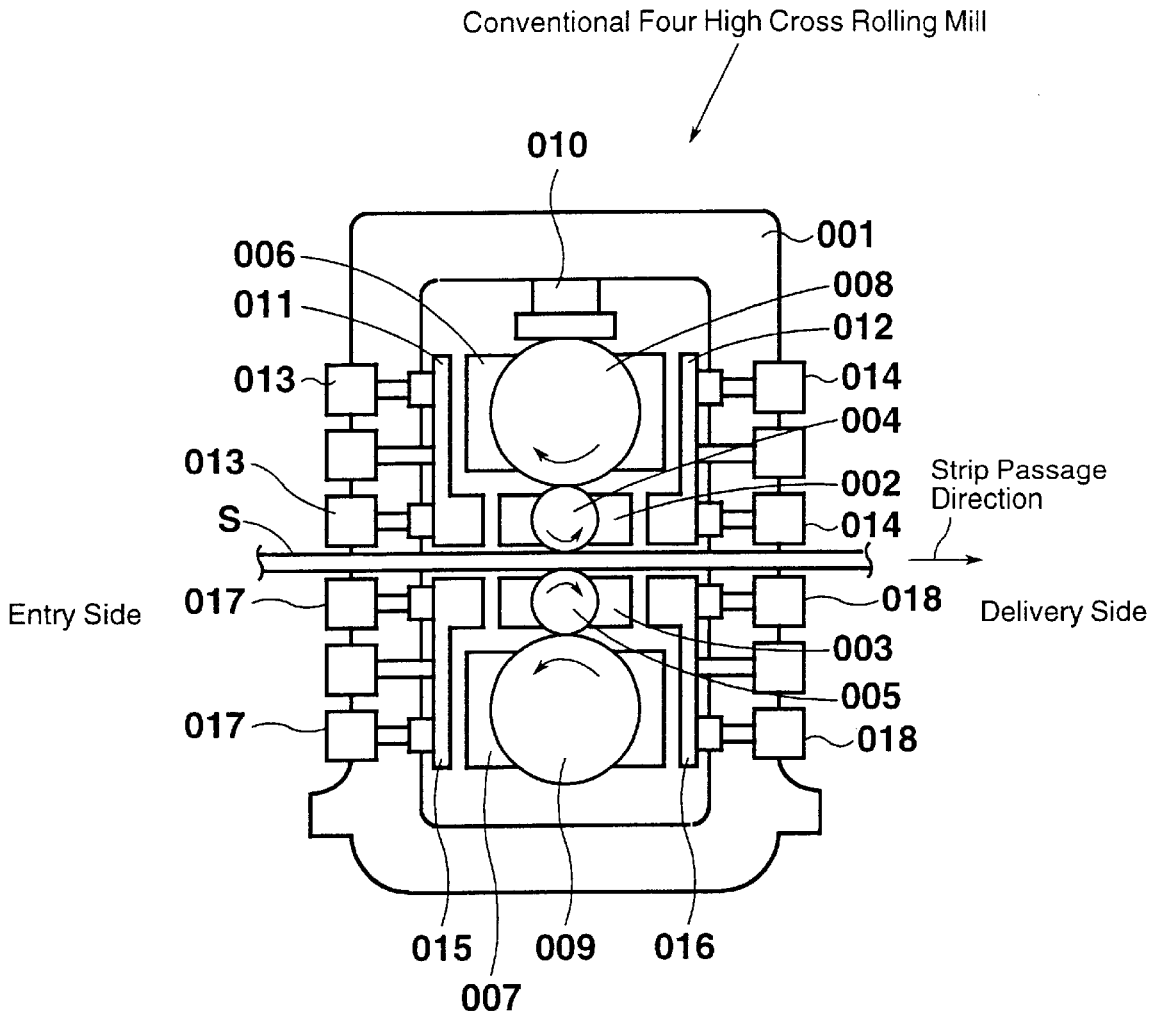
FIG. 15 is a schematic view of a conventional four high cross rolling mill.
Figure 16:
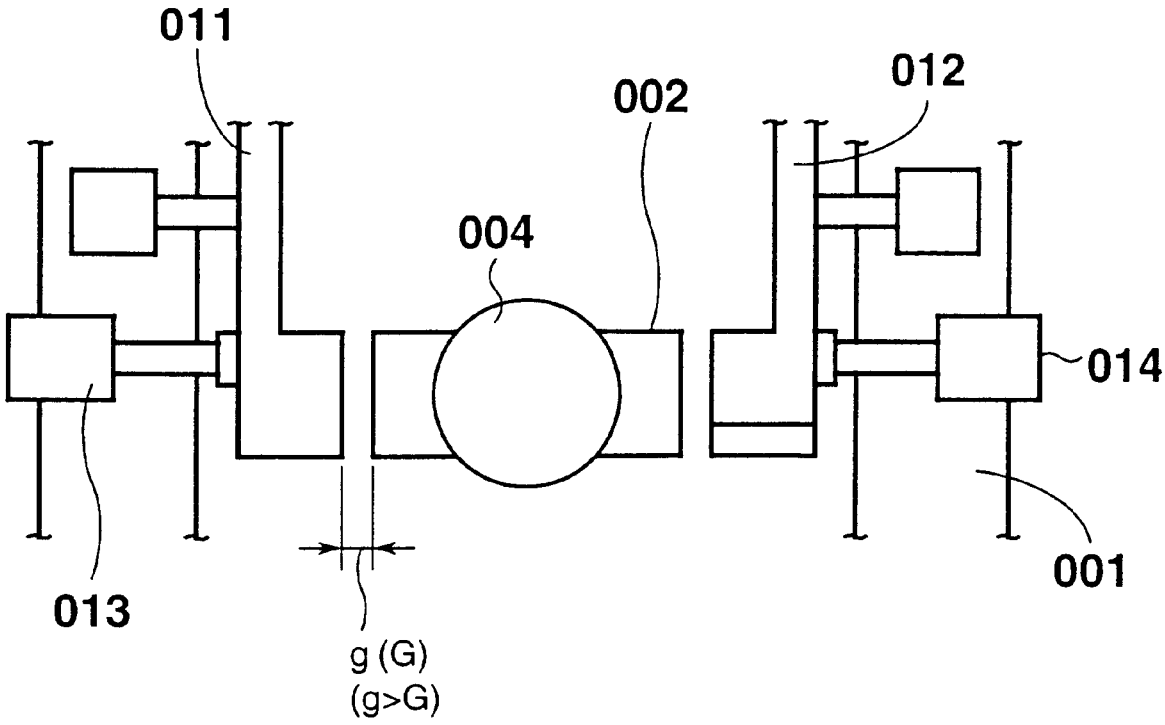
FIG. 16 is a schematic view of an essential part for illustrating a roll replacement operation in a cross rolling mill.
Figure 17:
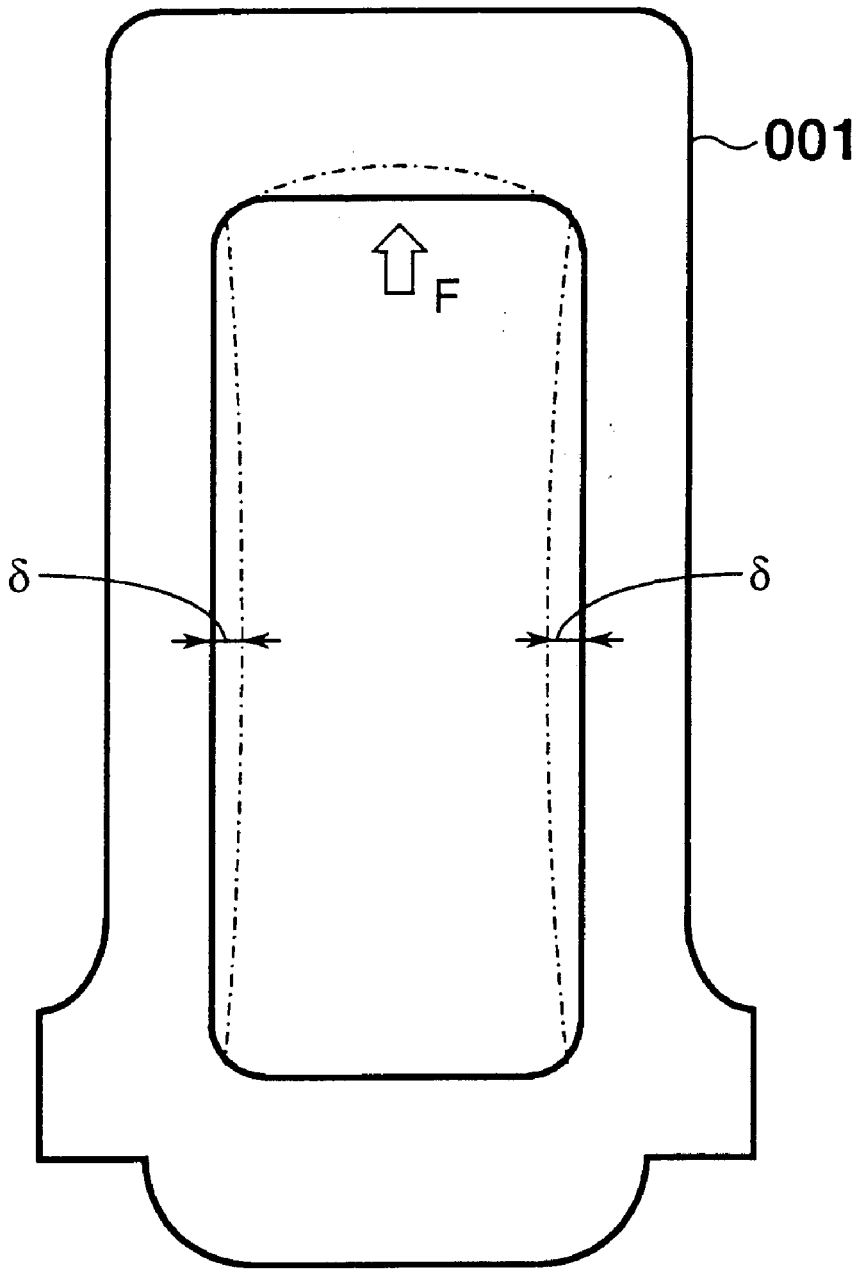
FIG. 17 is an explanation drawing showing stress acting on a housing during rolling in a conventional cross rolling mill.

A rolling mill according to a seventh embodiment is a shift rolling mill in which upper and lower work rolls can be shifted in the roll. axis direction. In this shift rolling mill, as shown in FIG. 14, upper and lower work rolls 14 and 15 are rotatably supported by work roll chocks 12 and 13. The work roll chocks 12, 13 have an entry side supported so as to be capable of being thrust by hydraulic cylinder mechanisms 141, 142, and have a delivery side supported by housing liner portions 143, 144 of a housing 11. Upper and lower backup rolls 18 and 19 are rotatably supported by backup roll chocks 16 and 17. The backup roll chocks 16, 17 have an entry side supported by housing liner portions 145, 146, and have a delivery side supported so as to be capable of being thrust by hydraulic cylinder mechanisms 147, 148. The hydraulic cylinder mechanisms 141, 142, 147, 148 are mounted on the housing 11, and each have a contraction portion (not shown). The housing liner portions 143, 144, 145, 146 horizontally support the roll chocks 12, 13, 16, 17 in cooperation with the pressing force of the hydraulic cylinder mechanisms 141, 142, 147, 148.

During rolling, therefore, a horizontal pressing force is exerted by thrusting the roll chocks 12, 13, 16, 17 against the housing liner portions 143, 144, 145, 146 of the housing 11 by the hydraulic cylinder mechanisms 141, 142, 147, 148. This horizontal pressing force, coupled with an inward narrowing deformation amount of the housing 11 responsive to a screw down load, increases the horizontal dynamic stiffness of the rolling mill. Even when rolling is performed in this state with a high rolling force and a high percentage reduction in the thickness of the strip, great vibrations do not occur, thus permitting high efficiency rolling. Moreover, the hydraulic cylinder mechanisms having their contraction portions control a gap amount G. For this purpose, an oil is filled into the cylinder to increase stiffness and simultaneously gain a pressure loss at the contraction portion, thereby increasing damping. In this manner, horizontal dynamic stiffness during rolling can be increased, and occurrence of vibrations during rolling can be lessened.

Industrial Applicability

As described above, the rolling mill of the present invention can eliminate gaps between roll chocks and a housing during rolling to increase horizontal dynamic stiffness, thereby suppressing mill vibrations and permitting high efficiency rolling. This rolling mill is preferred for use as a cross rolling mill, an offset rolling mill, and a shift rolling mill.

What is claimed is:

1. A rolling mill comprising:

a housing;

upper and lower work roll chocks forming a pair supported by the housing;

upper and lower work rolls forming a pair opposed to each other and having shafts rotatably supported by the upper and lower work roll chocks;

screw down means provided in an upper portion of the housing, the screw down means effective to apply a predetermined pressure to the upper work roll;

first upper and lower support means forming a pair provided on one side in a transport direction of a strip material in the housing, the first upper and lower support means effective to support the upper and lower work roll chocks; and second upper and lower support means forming a pair provided on an opposite side in the transport direction of the strip material in the housing and the second upper and lower support means effective to support the upper and lower work roll chocks, wherein one of the first support means and the second support means is mechanical thrust means, while the other of the first support means and the second support means is hydraulic thrust means, and contraction portions are provided in hydraulic supply and discharge pipes of the hydraulic thrust means.

2. The rolling mill of claim 1, wherein the rolling mill is a cross rolling mill with the upper and lower work rolls slightly crossing each other, the first support means is entry-side thrust means provided on an entry side of the housing, the first support means is effective of thrusting the upper and lower work roll chocks in the transport direction of the strip material, and the second support means is delivery-side thrust means provided on a delivery side of the housing, the second support means is effective to thrust the upper and lower work roll chocks in the transport direction of the strip material.

3. The rolling mill of claim 2, wherein the mechanical thrust means is screw mechanisms.

4. The rolling mill of claim 2, wherein the mechanical thrust means is wedge mechanisms.

5. The rolling mill of claim 2, further comprising upper and lower backup roll chocks forming a pair supported by the housing, and upper and lower backup rolls forming a pair opposed to each other and having shafts rotatably supported by the upper and lower backup roll chocks, wherein one of upper and lower entry-side thrust means and delivery-side thrust means forming a pair is effective to thrust the upper and lower backup roll chocks in a horizontal direction is mechanical thrust means, while the other of the entry-side thrust means and delivery-side thrust means is hydraulic thrust means, and contraction portions are provided in hydraulic supply and discharge pipes of the hydraulic thrust means.

6. The rolling mill of claim 1, wherein the diameters of the contraction portions are variable.

7. The rolling mill of claim 6, wherein the diameters of the contraction portions are maximized at a time of setting a cross angle between the upper and lower work rolls, and the diameters of the contraction portions during rolling by the upper and lower work rolls are set at appropriate predetermined values for each of rolling conditions.

8. The rolling mill of claim 1, wherein the contraction portions are electromagnetic valves.

9. The rolling mill of claim 1, wherein enlarged portions are provided in the hydraulic supply and discharge pipes.

10. The rolling mill of claim 1, wherein the rolling mill is an offset rolling mill in which upper and lower backup rolls as a pair in contact with the upper and lower work rolls, respectively, are supported by the housing via backup roll chocks, and the upper and lower backup rolls are slightly displaced relative to the upper and lower work rolls rearward in the transport direction of the strip material, the first support means is hydraulic thrust means provided on one of an entry side and a delivery side of the housing, the first support means is effective to thrust the upper and lower work roll chocks in the transport direction of the strip material, and having the contraction portions, and the second support means is housing liner portions provided on the other of the entry side and the delivery side of the housing.

11. The rolling mill of claim 1, wherein the rolling mill is a shift rolling mill for shifting the upper and lower work rolls as a pair in a roll axis direction, the first support means is hydraulic thrust means provided on one of an entry side and a delivery side of the housing, the first support means is effective to thrust the upper and lower work roll chocks in the transport direction of the strip material, and having the contraction portions, and the second support means is housing liner portions provided on the other of the entry side and the delivery side of the housing.

* * * * *